US010565840B2

(12) United States Patent
Vanchev et al.

(10) Patent No.: US 10,565,840 B2
(45) Date of Patent: Feb. 18, 2020

(54) ALARM REPORTING

(71) Applicant: AT&T Intellectual Property I, L.P., Atlanta, GA (US)

(72) Inventors: Plamen Vanchev, Suwanee, GA (US); Vani Aluka, Plainsboro, NJ (US)

(73) Assignee: AT&T INTELLECTUAL PROPERTY I, L.P., Atlanta, GA (US)

( * ) Notice: Subject to any disclaimer, the term of this patent is extended or adjusted under 35 U.S.C. 154(b) by 299 days.

(21) Appl. No.: 14/939,212

(22) Filed: Nov. 12, 2015

(65) Prior Publication Data

US 2017/0140620 A1 May 18, 2017

(51) Int. Cl.
*G08B 13/196* (2006.01)

(52) U.S. Cl.
CPC . *G08B 13/19658* (2013.01); *G08B 13/19669* (2013.01)

(58) Field of Classification Search
CPC ..... G08B 13/19658; G08B 13/19669
See application file for complete search history.

(56) References Cited

U.S. PATENT DOCUMENTS

| | | | |
|---|---|---|---|
| 4,259,548 A | 3/1981 | Fahey et al. | |
| 6,038,289 A | 3/2000 | Sands | |
| 6,067,346 A | 5/2000 | Akhteruzzaman et al. | |
| 6,271,752 B1 | 8/2001 | Vaios | |
| 6,356,058 B1 | 3/2002 | Maio | |
| 6,400,265 B1 | 6/2002 | Saylor et al. | |
| 6,504,479 B1 | 1/2003 | Lemons | |
| 6,636,489 B1 | 10/2003 | Fingerhut | |
| 6,658,091 B1 | 12/2003 | Naidoo et al. | |
| 6,693,530 B1 | 2/2004 | Dowens et al. | |
| 6,741,171 B2 | 5/2004 | Palka et al. | |
| 6,778,085 B2 | 8/2004 | Faulkner | |
| 6,829,478 B1 | 12/2004 | Layton et al. | |
| 6,884,826 B2 | 4/2005 | Le-Khac et al. | |
| 6,914,896 B1 | 7/2005 | Tomalewicz | |
| 6,970,183 B1 * | 11/2005 | Monroe | G08B 7/062 348/143 |
| 6,975,220 B1 | 12/2005 | Foodman et al. | |
| 6,977,585 B2 | 12/2005 | Falk et al. | |
| 7,015,806 B2 | 3/2006 | Naidoo et al. | |
| 7,020,796 B1 | 3/2006 | Ennis et al. | |
| 7,035,650 B1 | 4/2006 | Moskowitz et al. | |

(Continued)

FOREIGN PATENT DOCUMENTS

| | | |
|---|---|---|
| JP | 2014216663 A | 11/2014 |
| KR | 20070105430 A | 10/2007 |

OTHER PUBLICATIONS

U.S. Appl. No. 14/854,294, Hicks, III, John Alson.

(Continued)

*Primary Examiner* — Christopher G Findley
(74) *Attorney, Agent, or Firm* — Scott P. Zimmerman, PLLC

(57) ABSTRACT

Events are generated by a security controller. Video confirmation of the events is routed via a wireline broadband connection to conserve bandwidth in a cellular network. However, when the wireline broadband connection is unavailable, video confirmation of alarms may be routed into a cellular network for processing. Video associated with benign events may be stored until the wireline broadband connection is restored.

19 Claims, 25 Drawing Sheets

(56) References Cited

U.S. PATENT DOCUMENTS 7,113,090 B1 9/2006 Saylor et al.
7,239,689 B2 7/2007 Diomelli
7,248,161 B2 7/2007 Spoltore et al.
7,249,370 B2 7/2007 Kodama
7,295,119 B2 11/2007 Rappaport et al.
7,323,980 B2 1/2008 Faulkner et al.
7,409,045 B2 8/2008 Naidoo
7,492,253 B2 2/2009 Ollis et al.
7,515,041 B2 4/2009 Eisold et al.
7,633,385 B2 12/2009 Cohn et al.
7,679,507 B2 3/2010 Babich et al.
7,688,203 B2 3/2010 Rockefeller et al.
7,724,131 B2 5/2010 Chen
7,768,414 B2 8/2010 Abel et al.
7,772,971 B1 8/2010 Hillenburg et al.
7,779,141 B2 8/2010 Hashimoto et al.
7,853,261 B1 12/2010 Lewis et al.
7,855,635 B2 12/2010 Cohn et al.
7,920,580 B2 4/2011 Bedingfield, Sr.
7,920,843 B2 4/2011 Martin et al.
7,952,609 B2 5/2011 Simerly et al.
8,284,254 B2 10/2012 Romanowich et al.
8,373,538 B1 2/2013 Hildner et al.
8,391,826 B2 3/2013 McKenna et al.
8,401,514 B2 3/2013 Ebdon et al.
8,405,499 B2 3/2013 Hicks, III
8,471,910 B2 6/2013 Cleary et al.
8,520,068 B2 8/2013 Naidoo et al.
8,581,991 B1 11/2013 Clemente
8,626,210 B2 1/2014 Hicks, III
8,649,758 B2 2/2014 Sennett et al.
8,674,823 B1 3/2014 Contario et al.
8,692,665 B2 4/2014 Hicks, III
8,780,199 B2 7/2014 Mimar
8,831,970 B2 9/2014 Weik et al.
8,847,749 B2 9/2014 Hicks, III
8,884,772 B1 11/2014 Zhang
8,902,740 B2 12/2014 Hicks, III
8,937,658 B2 1/2015 Hicks, III
8,970,365 B2 3/2015 Wedig et al.
9,060,116 B2 6/2015 Kim
9,135,806 B2 9/2015 Hicks
9,246,740 B2 1/2016 Hicks
9,318,005 B2 4/2016 Hicks
2002/0175995 A1 11/2002 Sleeckx
2002/0193107 A1 12/2002 Nascimento
2003/0025599 A1 2/2003 Monroe
2003/0062997 A1 4/2003 Naidoo
2003/0179712 A1 9/2003 Kobayashi et al.
2003/0227220 A1 12/2003 Biskup et al.
2004/0028391 A1 2/2004 Black et al.
2004/0086088 A1 5/2004 Naidoo et al.
2004/0086091 A1 5/2004 Naidoo et al.
2004/0086093 A1 5/2004 Schranz
2004/0113770 A1 6/2004 Falk
2004/0137959 A1 7/2004 Salzhauer
2004/0177136 A1 9/2004 Chen et al.
2004/0196833 A1 10/2004 Dahan et al.
2004/0233983 A1 11/2004 Crawford et al.
2005/0066033 A1 3/2005 Cheston et al.
2005/0068175 A1 3/2005 Faulkner et al.
2005/0174229 A1 8/2005 Feldkamp
2006/0002721 A1 1/2006 Sasaki
2006/0028488 A1 2/2006 Gabay et al.
2006/0055529 A1 3/2006 Ratiu et al.
2006/0064505 A1 3/2006 Lee et al.
2006/0067484 A1 3/2006 Elliot et al.
2006/0154642 A1 7/2006 Scannell, Jr.
2006/0170778 A1 8/2006 Ely
2006/0239250 A1 10/2006 Elliot et al.
2006/0271695 A1 11/2006 Lavian
2007/0049259 A1 3/2007 Onishi et al.
2007/0104218 A1 5/2007 Hassan et al.
2007/0115930 A1 5/2007 Reynolds et al.
2007/0124782 A1 5/2007 Hiral et al.
2007/0139192 A1 6/2007 Wimberly et al.
2007/0226344 A1 9/2007 Sparrell et al.
2007/0247187 A1 10/2007 Webber et al.
2007/0279214 A1 12/2007 Buehler
2007/0290830 A1 12/2007 Gurley
2008/0055423 A1 3/2008 Ying
2008/0061923 A1 3/2008 Simon et al.
2008/0090546 A1 4/2008 Dickenson et al.
2008/0167068 A1 7/2008 Mosleh et al.
2008/0191857 A1 8/2008 Mojaver
2008/0225120 A1 9/2008 Stuecker
2008/0261515 A1 10/2008 Cohn et al.
2008/0279345 A1 11/2008 Zellner et al.
2008/0311878 A1 12/2008 Martin et al.
2008/0311879 A1 12/2008 Martin et al.
2009/0006525 A1 1/2009 Moore
2009/0010493 A1 1/2009 Gornick
2009/0017751 A1 1/2009 Blum
2009/0047016 A1 2/2009 Bernard et al.
2009/0058630 A1 3/2009 Friar et al.
2009/0060530 A1 3/2009 Biegert et al.
2009/0109898 A1 4/2009 Adams et al.
2009/0191858 A1 7/2009 Calisti et al.
2009/0267754 A1 10/2009 Nguyen et al.
2009/0274104 A1 11/2009 Addy
2009/0276713 A1 11/2009 Eddy
2009/0285369 A1 11/2009 Kandala
2009/0315699 A1 12/2009 Satish et al.
2009/0323904 A1 12/2009 Shapiro et al.
2010/0071024 A1 3/2010 Eyada
2010/0073856 A1 3/2010 Huang et al.
2010/0145161 A1 6/2010 Niyato et al.
2010/0279664 A1 11/2010 Chalk
2010/0281312 A1 11/2010 Cohn et al.
2010/0302025 A1 12/2010 Script
2010/0302938 A1 12/2010 So
2011/0003577 A1 1/2011 Rogalski et al.
2011/0032109 A1* 2/2011 Fox ..... G08B 25/006
340/628
2011/0044210 A1 2/2011 Yokota
2011/0058034 A1 3/2011 Grass
2011/0090334 A1 4/2011 Hicks, III
2011/0113142 A1 5/2011 Rangegowda et al.
2011/0183643 A1 7/2011 Martin et al.
2011/0197246 A1 8/2011 Stancato et al.
2011/0211440 A1 9/2011 Arsenault et al.
2011/0244854 A1 10/2011 Hansson et al.
2011/0254681 A1 10/2011 Perkinson
2011/0317622 A1 12/2011 Arsenault
2012/0084857 A1 4/2012 Hubner
2012/0099253 A1 4/2012 Tang
2012/0099256 A1 4/2012 Fawcett
2012/0163380 A1 6/2012 Kolbe et al.
2012/0190386 A1 7/2012 Anderson
2012/0278453 A1 11/2012 Baum
2012/0314597 A1 12/2012 Singh et al.
2013/0027561 A1 1/2013 Lee
2013/0099919 A1 4/2013 Cai et al.
2013/0103309 A1 4/2013 Cai et al.
2013/0120132 A1 5/2013 Hicks, III
2013/0120138 A1 5/2013 Hicks, III
2013/0121239 A1 5/2013 Hicks, III
2013/0135993 A1 5/2013 Morrill et al.
2013/0155245 A1 6/2013 Slamka
2013/0170489 A1 7/2013 Hicks, III
2013/0214925 A1 8/2013 Weiss
2013/0235209 A1 9/2013 Lee et al.
2013/0273875 A1 10/2013 Martin et al.
2014/0095164 A1 4/2014 Sone et al.
2014/0167969 A1 6/2014 Wedig
2014/0253326 A1 9/2014 Cho et al.
2015/0054645 A1 2/2015 Hicks, III
2015/0056946 A1 2/2015 Leggett et al.
2015/0085130 A1 3/2015 Hicks, III
2015/0097683 A1 4/2015 Sloo et al.
2015/0137967 A1 5/2015 Wedig et al.
2015/0364029 A1 12/2015 Hicks, III
2016/0284205 A1 6/2016 Hicks, III
2016/0196734 A1 7/2016 Hicks, III

(56) References Cited

U.S. PATENT DOCUMENTS

| | | | |
|---|---|---|---|
| 2016/0225239 | A1 | 8/2016 | Hicks, III |
| 2017/0076562 | A1 | 3/2017 | Hicks, III |
| 2017/0132890 | A1 | 5/2017 | Hicks, III |
| 2017/0140620 | A1 | 5/2017 | Hicks, III |

OTHER PUBLICATIONS

Aedo, Ignacio, et al., "Personalized Alert Notifications and Evacuation Routes in Indoor Environments," *Sensors* 12.6 (2012): 7804-7827, 24 pages.

* cited by examiner

ALARM REPORTING

COPYRIGHT NOTIFICATION

A portion of the disclosure of this patent document and its attachments contain material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

BACKGROUND

Video data can waste network resources. For example, some security systems route the video data into a cellular network for delivery to some destination. This video data, though, often unnecessarily consumes bandwidth in the cellular network.

BRIEF DESCRIPTION OF THE SEVERAL VIEWS OF THE DRAWINGS

The features, aspects, and advantages of the exemplary embodiments are understood when the following Detailed Description is read with reference to the accompanying drawings, wherein.

DETAILED DESCRIPTION

The exemplary embodiments will now be described more fully hereinafter with reference to the accompanying drawings. The exemplary embodiments may, however, be embodied in many different forms and should not be construed as limited to the embodiments set forth herein. These embodiments are provided so that this disclosure will be thorough and complete and will fully convey the exemplary embodiments to those of ordinary skill in the art. Moreover, all statements herein reciting embodiments, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or processes illustrating the exemplary embodiments. The functions of the various elements shown in the figures may be provided through the use of dedicated hardware as well as hardware capable of executing associated software. Those of ordinary skill in the art further understand that the exemplary hardware, software, processes, methods, and/or operating systems described herein are for illustrative purposes and, thus, are not intended to be limited to any particular named manufacturer.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

It will also be understood that, although the terms first, second, etc. may be used herein to describe various elements, these elements should not be limited by these terms. These terms are only used to distinguish one element from another. For example, a first device could be termed a second device, and, similarly, a second device could be termed a first device without departing from the teachings of the disclosure.

Figure 1:
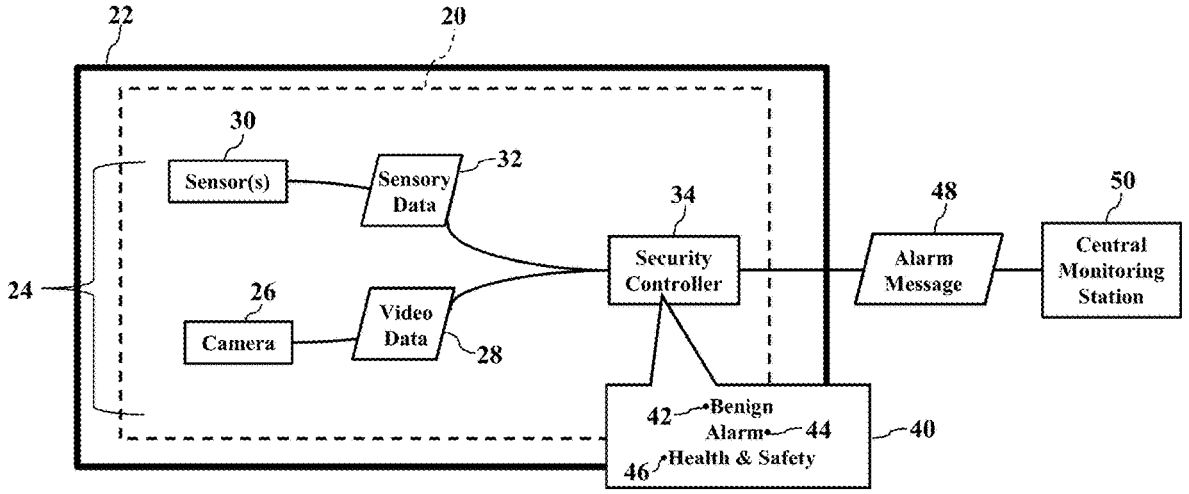
FIGS. 1-8 are simplified schematics illustrating an environment in which exemplary embodiments may be implemented.

FIGS. 1-8 are simplified illustrations of an operating environment, according to exemplary embodiments. While exemplary embodiments may be implemented in many environments, FIG. 1 illustrates a common operating environment that most readers will understand. A security system 20 is installed in a building 22, such as a home or business. The security system 20 may have many sensors 24 that protect occupants from fire, intrusion, and other security conditions. For example, a wireless or wired camera 26 captures video data 28 of some area inside or outside the building 22. Other sensors 30 (such as motion detectors, carbon monoxide and fire sensors, water sensors, and any other sensory devices) may also monitor areas and generate sensory data 32. The video data 28 and any other sensory data 32 may be sent to a security controller 34. The security controller 34 may use or evaluate the video data 28 and the sensory data 32 and generates various events 40. Some of the events 40 may be categorized as benign events 42, while other events 40 may be categorized as alarm events 44. That is, some of the sensory data 32 may indicate a health or safety concern 46 that requires emergency reporting (such as a fire, intrusion, or other alarm event 44). The security controller 34 may thus generate an alarm message 48 that summons emergency personnel (such as a central monitoring station 50, as is known). However, the benign events 42 may be comparatively routine or minor tasks having little or no urgency, consequence, or importance.

Figure 2:
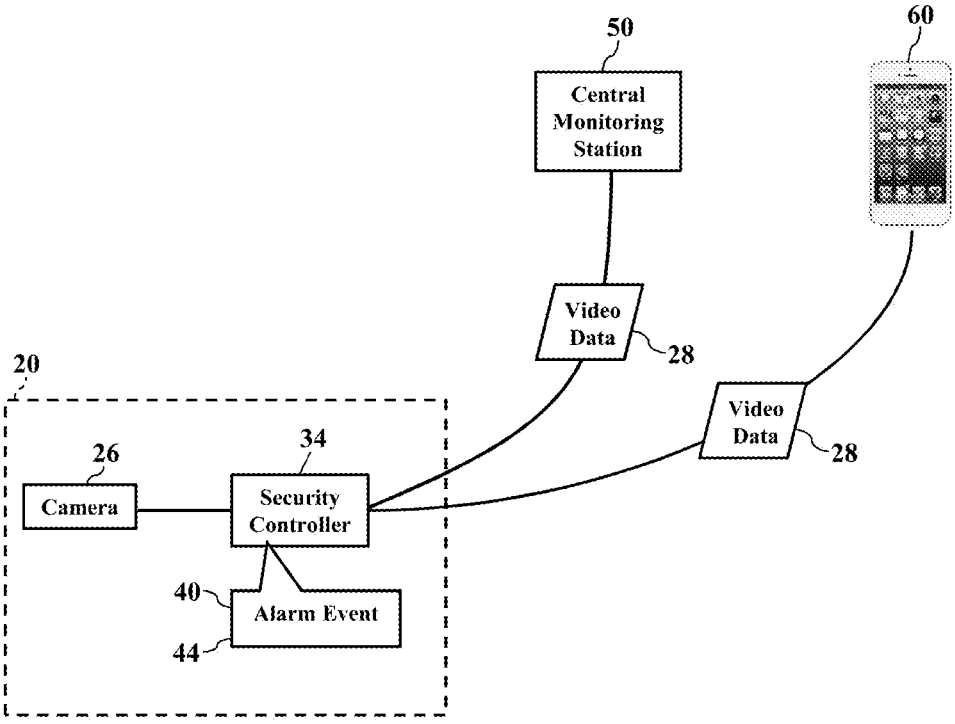

FIG. 2 illustrates video confirmation. When the security controller 34 determines any event 40, the security controller 34 may also retrieve the video data 28 as documentary evidence. That is, the security controller 34 sends a command to the network address associated with the video camera 26. The command instructs the video camera 26 to generate and send the video data 28 in response to the corresponding event 40. Presumptively the video camera 26 is aimed in the general direction associated with the event 40, thus capturing documentary evidence. For example, suppose the alarm event 44 indicates heat, smoke, or other indication of fire. The security controller 34 may thus instruct the video camera 26 to send the video data 28 of the area experiencing the smoke or heat. The video data 26 may be sent to the central monitoring station 50 for confirmation. If the video data 28 confirms the alarm event 44, emergency personnel may be summoned, as is generally known. The video data 26 may also be sent to other notification addresses, such as an address associated with a mobile smartphone 60. A user of the smartphone 60 may also view the video data 26 to confirm the alarm event 44.

Figure 3:
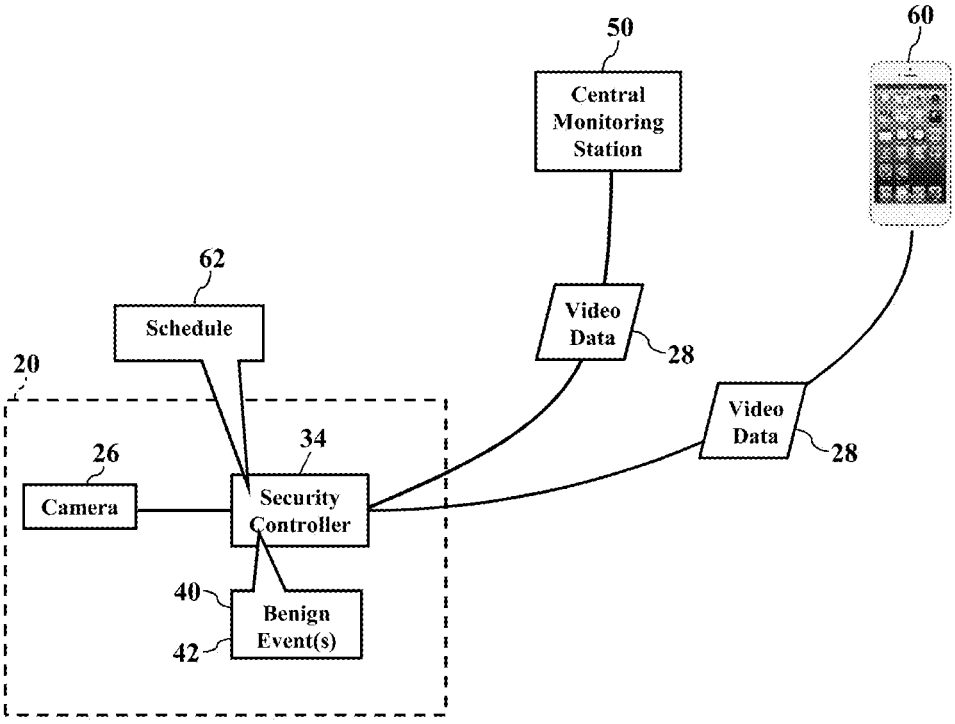

FIG. 3 illustrates the benign events 42. As the reader may understand, there may be many other situations in which the video data 28 is desired from the video camera 26. These events 40 are not associated with an imminent health and safety concern. For example, suppose the video camera 26 aims toward a front door of a home. When a human visitor activates a doorbell, the security controller 34 may instruct the video camera 26 to capture the video data 28 of the visitor at the door. The video data 28 may thus be sent to any destination for confirmation of the visitor. The user of the smartphone 60 may thus remotely see the human visitor that activated the doorbell. Activation of the doorbell, in other words, triggered one of the benign events 42 that required remote notification and monitoring of the video camera 26 aimed toward the front door. Other benign events 42 may include periodically or randomly requested videos or snapshots of rooms or occupants. Some security customers, for example, may configure the security system 20 to require periodic video sweeps of the home or business. That is, the security controller 34 may execute a schedule 62 that periodically or randomly generates the video data 28 for remote notification and monitoring. The security controller 34 may thus send even more video data 28 according to any scheduled task or operation.

Figure 4:
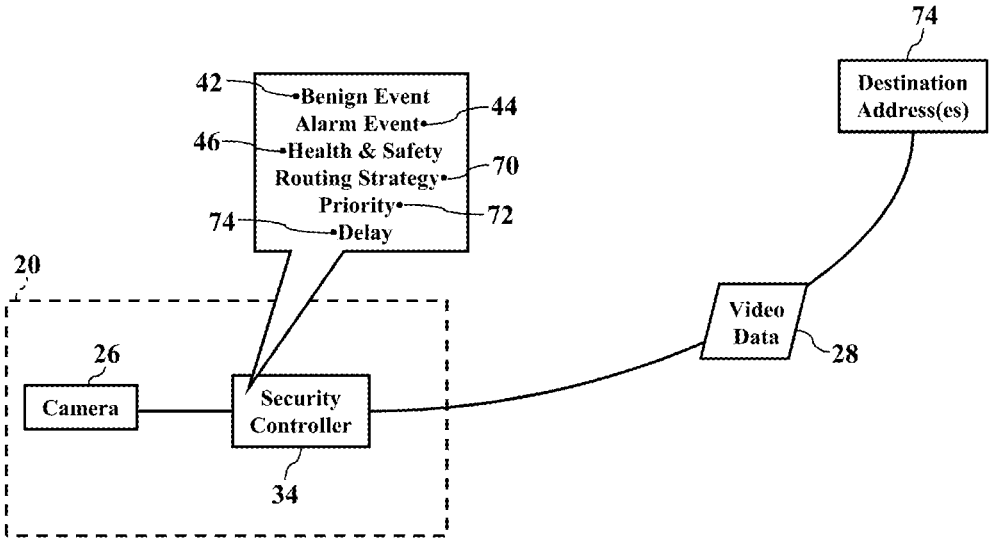

FIG. 4 illustrates routing strategies 70. Here exemplary embodiments may treat the alarm events 44 differently from the benign events 42. The reader may now understand that some video data 28 is more important than others. The alarm events 44, for example, generally indicate the potential health or safety concern 46 and should be reported with priority 72. The benign events 42, though, are comparatively unimportant and may be reported with less priority 72. Exemplary embodiments may thus route the video data 28 based on the priority 72 associated with the event 40. That is, the alarm events 44 and/or their corresponding video data 28 may have a routing strategy 70 that escalates their priority 72. Because the alarm events 44 may indicate life or property is in jeopardy, exemplary embodiments may immediately or nearly immediately send the corresponding video data 28 for routing and delivery to a destination address 74. The video data 28 may even have the priority 72 over less important traffic to further ensure faster/shorter routing with less delay, jitter, and other ill-effects.

The benign events 42, however, may have a different routing strategy 70. The benign events 42 are comparatively routine or minor with little or no urgency, consequence, or importance. The corresponding video data 28 is similarly of a lesser concern. Exemplary embodiments may thus judiciously route the video data 28 associated with the benign events 42. For example, the security controller 34 may implement a delay 76 before sending the video data 28 representing the benign events 42. That is, the security controller 34 may locally cache or store the video data 28 representing the benign events 42 until some condition 78 is satisfied. There may be many conditions 78 depending on the circumstances. Regardless, when the conditions 78 are satisfied, the security controller 34 may then release the video data 28 for routing and delivery to the destination address 74. In simple words, the video data 28 representing the benign events 42 may have a lesser priority 72 that the alarm events 44.

Figure 5:
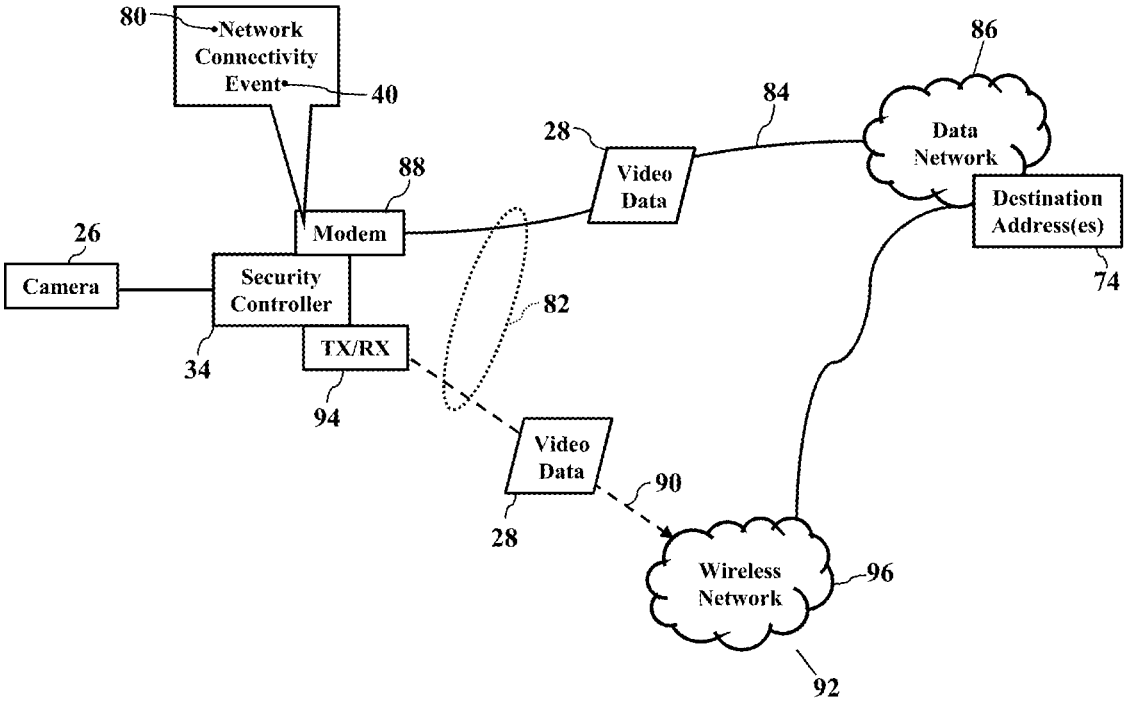
Figure 6:
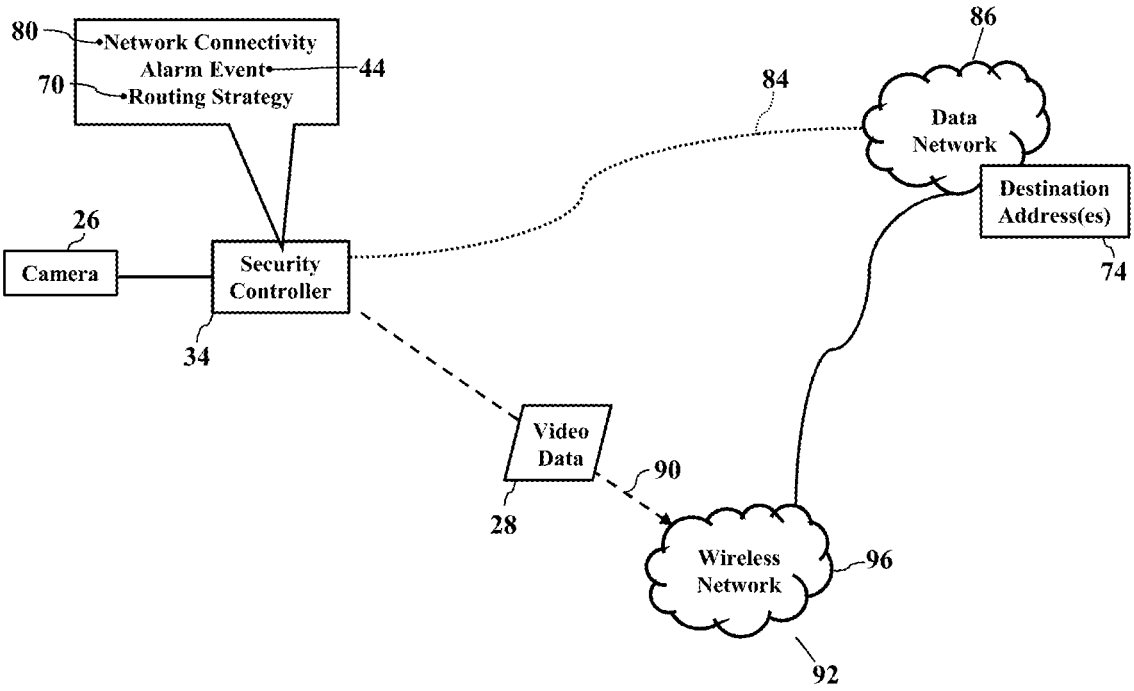

FIGS. 5-6 illustrate network connectivity 80. two different communications paths 82 when routing the video data 28. The security controller 34, for example, may have a wireline broadband connection 84 to a data network 86. The security controller 34 may thus interface with a modem 88 (such as cable or DSL) to send the video data 28 along the wireline broadband connection 84 and into the data network 86 for routing to the destination address 74. Moreover, the security controller 34 may also have a second wireless connection 90 to a wireless network 92. For example, the security controller 34 may have a cellular transceiver ("TX/RX") 94 that wirelessly sends the video data 28 into a private cellular network 96 for routing to the data network 86. Whenever the security controller 34 determines any event 40, the security controller 34 may send the corresponding video data 28 into or over one of the two different communications paths 84 and/or 90.

FIG. 6 illustrates cellular routing. Here exemplary embodiments may utilize the wireless connection 90 only when urgent. That is, the private cellular network 96 may be reserved for when the wireline broadband connection 84 is down or otherwise unavailable. As the reader may understand, the performance of wireless networks may be affected by traffic. As more and more of the video data 28 is wirelessly sent into the wireless network 92, bandwidth (e.g., speed or bitrate) and other performance parameters may suffer or degrade. Exemplary embodiments may thus only select the private cellular network 96 for only the most urgent of the events 40 and/or when the security controller 34 lacks the network connectivity 80 to the wireline broadband connection 84. That is, if the security controller 34 determines the alarm event 44 and determines the wireline broadband connection 84 is unavailable, then one of the routing strategies 70 may route the video data 28 associated with the alarm event 44 via the wireless connection 90 to the private cellular network 96.

Figure 7:
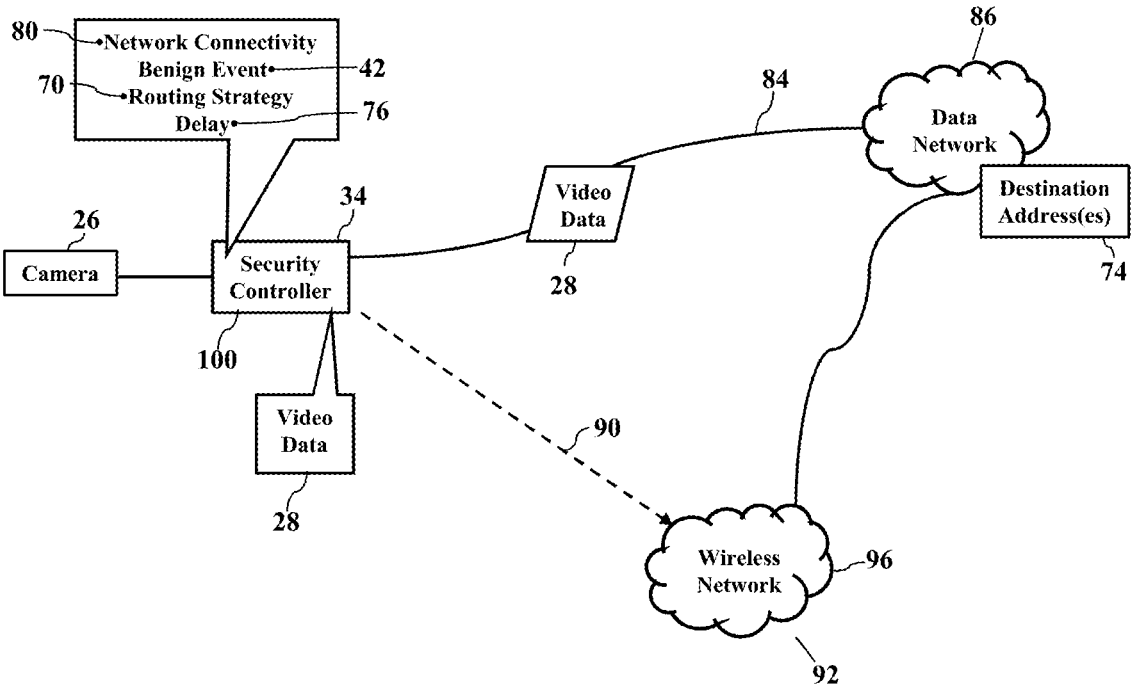

FIG. 7 illustrates benign routing. Here the benign events 42 may have a different routing strategy 70. The benign events 42 are comparatively routine or minor. Their corresponding video data 28, likewise, may also have a lesser concern. So, when the wireline broadband connection 84 is unavailable, the benign events 42 (and their associated video data 28) may be delayed until restoration. That is, the security controller 34 may decline to route the video data 28 via the wireless connection 90 into the private cellular network 96. The security controller 34, instead, may implement the delay 76 and store the video data 28 (representing the benign events 42) in a local memory 100. The security controller 34, for example, may hold the benign events 42 and/or their associated video data 28 until the network connectivity 80 indicates the wireline broadband connection 84 is available. The lesser-important video data 28, in other words, may thus be later routed in time via the wireline broadband connection 84. Here, then, the delay 76 conserves bandwidth in the private cellular network 96 for only the urgent alarm events 44.

Exemplary embodiments reduce congestion. All the different events 40, and their associated video data 28, may generate significant cellular data usage. Exemplary embodiments may thus upload only the most urgent video data 28 associated with the alarm events 44. This routing strategy 70 minimizes cellular traffic, reduces operational costs, and decreases cellular congestion. The video data 28 associated with the benign events 42 (such as routine or scheduled tasks and "snapshots") may be cached until broadband service is restored. Should cache memory 100 become full, exemplary embodiments may allocate more memory 100 for storing additional video data 28. Exemplary embodiments may optionally begin utilizing the wireless connection 90, even for the benign events 42, in response to the cache memory 100 approaching a maximum byte size. This intelligent "store and forward" routing strategy 70 may be managed by a software application and/or by firmware (such as the security controller 34). Exemplary embodiments thus smartly prioritize alarm traffic over the 3G/4G/LTE wireless connection 90.

Figure 8:
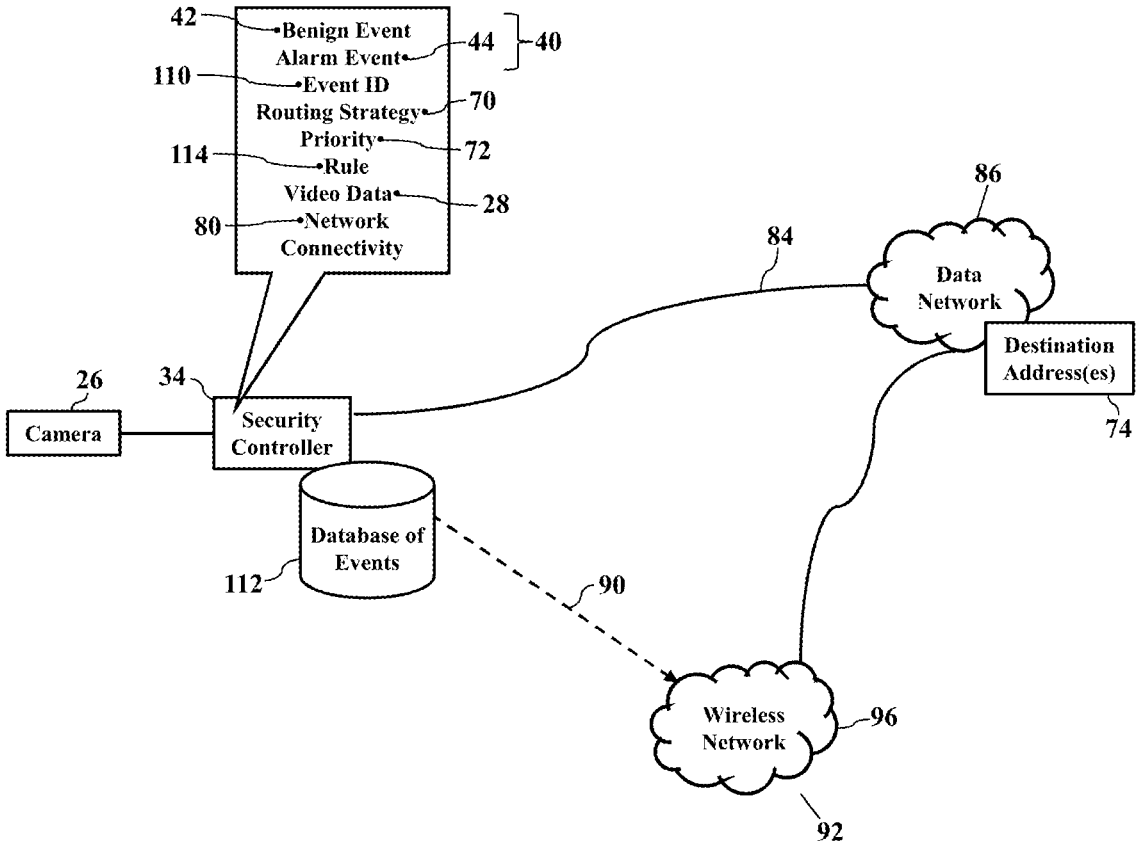

FIG. 8 expands the routing strategies 70. Here each different event 40 may have its own routing strategy 70. The security controller 34 generates many different events 40, depending on its programming and configuration (as earlier explained). As there may be many different events 40, each one of the events 40 may have an associated event identifier (or "event ID") 110. The event identifier 110 may be any alphanumeric combination or other symbolic representation of the corresponding event 40. Each event identifier 110 may thus correspond to the sensor 24 and/or the sensory data 32 responsible for the event 40 (such as the camera 26 generating the video data 28). For example, some event identifiers 110 may be associated with the alarm events 44 that indicate heat or smoke or fire. Other event identifiers 110 may be associated with the alarm events 44 that indicate intrusion (infrared, motion, open contact, or glass breakage). Indeed, there may be many event identifiers 110 that are associated with the different alarm events 44. Similarly, more event identifiers 110 may be associated with the different benign events 42 that are not so important.

Exemplary embodiments may consult an electronic database 112 of events. The database 112 of events is illustrated as being locally stored in the security controller 34, but the database 112 of events may be remotely stored and accessed. Once the security controller 34 assigns or determines the event identifier 110, the security controller 34 may query the database 112 of events for the event identifier 110 and retrieve its corresponding priority 72 and routing strategy 70. Each event 40, in other words, may have an electronic database association with its corresponding event identifier 110, its corresponding priority 72, and its corresponding routing strategy 70. Whenever the security controller 34 generates or determines one of the events 40, the security controller 34 may query the electronic database 112 of events and retrieve the corresponding event identifier 110, its priority 72, and its routing strategy 70.

Exemplary embodiments may thus perform a database lookup. Suppose all the benign events 42 have the same routing strategy 70. That is, as earlier explained, perhaps all the benign events 42 are reserved for the wireline broadband connection 84. The electronic database 112 of events may thus have entries specifying the wireline broadband connection 84 for any event identifier 110 having the "benign" priority 72. The security controller 34 may cache or hold back the video data 28 associated with any benign event 42 until the wireline broadband connection 84 is available (e.g., its network connectivity 80 is confirmed or verified). Indeed, exemplary embodiments may command or enforce a general rule 114 that the wireline broadband connection 84 is preferred for all events 40, regardless of the priority 72. However, if the event identifier 110 indicates the "alarm" priority 72, and the wireline broadband connection 84 is down (e.g., its network connectivity 80 indicates unavailable), the routing strategy 70 may authorize or permit routing the video data 28 via the wireless connection 90 into the private cellular network 96. The routing strategy 70, in other words, may override or supersede the general rule 114 that prefers the wireline broadband connection 84. Exemplary embodiments thus ensure that the alarm events 44 are urgently relayed.

Wireless resources are thus conserved. Exemplary embodiments judiciously reserve the private cellular network 96 for perhaps only the urgent situations (e.g., the alarm events 44). The general routing rule 114 may thus force all messages and packets of data (such as the video data 28) via the wireline broadband connection 84, even if the wireless connection 90 is simultaneously available. Exemplary embodiments may thus prefer the wireline broadband connection 84 that has perhaps a substantially greater bitrate and can accommodate more packet traffic. However, when the security controller 34 determines an error with the wireline broadband connection 84, the routing strategy 70 may permit an alternative routing via the wireless connection 90 into the private cellular network 96. The alarm events 44, for example, may be wirelessly sent to ensure reporting and summons.

Figure 9:
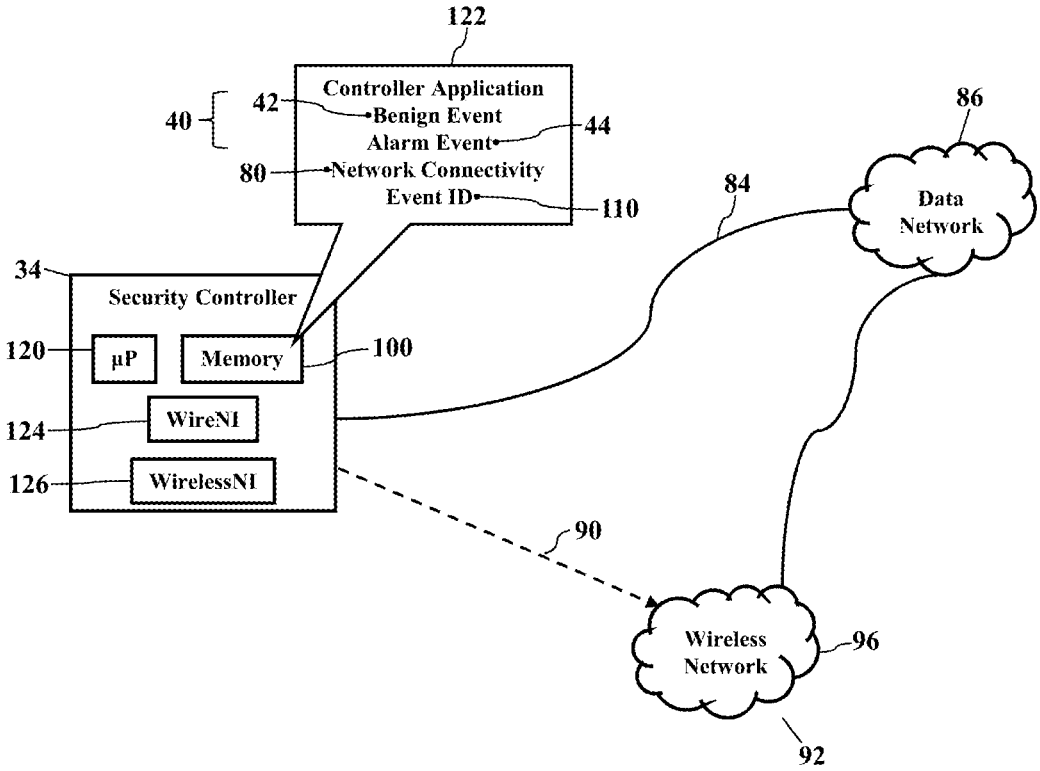
FIG. 9 is a more detailed block diagram illustrating the operating environment, according to exemplary embodiments.

FIG. 9 is a more detailed block diagram illustrating the operating environment, according to exemplary embodiments. The security controller 34 communicates with the data network 86 via the wireline broadband connection 84. The security controller 34 communicates with the wireless network 92 via the wireless connection 90. The security controller 34 has a processor 120 (e.g., "μP"), application specific integrated circuit (ASIC), or other component that executes a controller application 122 stored in the memory device 100. The controller application 122 instructs the processor 120 to perform operations, such as determining the network connectivity 80 associated with the wireline broadband connection 84 and the wireless connection 90. As FIG. 9 illustrates, the security controller 34 may have multiple network interfaces to multiple networks. A wireline network interface (or "WireNI") 124, for example, allows the security controller 34 to communicate via the wireline broadband connection 84 with the data network 86. A wireless network interface ("WirelessNI") 126 allows the security controller 34 to communicate via the wireless connection 90 with the private cellular network 96. The controller application 122 may thus instruct the processor 120 to evaluate the network connectivity 80 associated with either or both the wireline network interface 124 and the wireless network interface 126.

Any connectivity scheme may be used. There are many known connectivity schemes, such as polling or "ping" messages to determine a status of the corresponding connection 84 and 90. If no response is received, or if an error code indicates an operational concern or unavailability, the security controller 34 may infer or conclude that the corresponding connection 84 or 90 is down. Regardless, exemplary embodiments may utilize any other scheme for determining the network connectivity 80.

The security controller 34 may generate the events 40. The controller application 122 may assign the event identifier 110 to each event 40. While there may be hundreds or perhaps thousands of different events 40, in actual practice the events 40 may be generally categorized or grouped based on some common criterion or criteria. Exemplary embodiments may thus map all the different events 40 to a lesser or more manageable number by assigning a common one of the different event identifiers 110.

Exemplary embodiments may be applied regardless of networking environment. Exemplary embodiments may be easily adapted to stationary or mobile devices having cellular, WI-FI®, near field, and/or BLUETOOTH® capability. Exemplary embodiments may be applied to mobile devices utilizing any portion of the electromagnetic spectrum and any signaling standard (such as the IEEE 802 family of standards, GSM/CDMA/TDMA or any cellular standard, and/or the ISM band). Exemplary embodiments, however, may be applied to any processor-controlled device operating in the radio-frequency domain and/or the Internet Protocol (IP) domain. Exemplary embodiments may be applied to any processor-controlled device utilizing a distributed computing network, such as the Internet (sometimes alternatively known as the "World Wide Web"), an intranet, a local-area network (LAN), and/or a wide-area network (WAN). Exemplary embodiments may be applied to any processor-controlled device utilizing power line technologies, in which signals are communicated via electrical wiring. Indeed, exemplary embodiments may be applied regardless of physical componentry, physical configuration, or communications standard(s).

Exemplary embodiments may utilize any processing component, configuration, or system. Any processor could be multiple processors, which could include distributed processors or parallel processors in a single machine or multiple machines. The processor can be used in supporting a virtual processing environment. The processor could include a state machine, application specific integrated circuit (ASIC), and/or a programmable gate array (PGA) including a Field PGA. When any of the processors execute instructions to perform "operations", this could include the processor performing the operations directly and/or facilitating, directing, or cooperating with another device or component to perform the operations.

Figure 10:
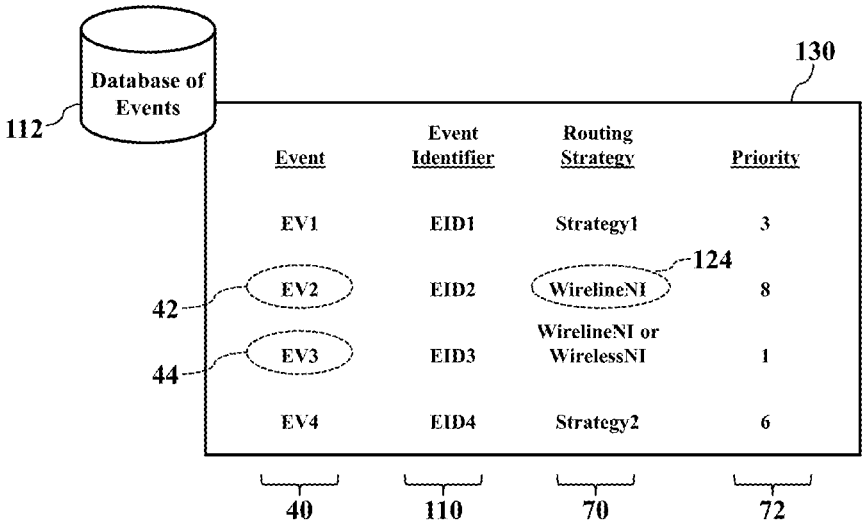
FIG. 10 illustrates an electronic database of events, according to exemplary embodiments.

FIG. 10 illustrates the electronic database 112 of events, according to exemplary embodiments. Once the event identifier 110 is assigned, the controller application 122 may consult the electronic database 112 of events. The controller application 122 queries for the event identifier 110 and retrieves the matching database entries. FIG. 10 illustrates the electronic database 112 of events as a table 130 that maps, relates, or associates the event 40 and/or the event identifier 110 to its corresponding routing strategy 70 and the priority 72. One of the routing strategies 70, for example, may require all benign events 42 to utilize the wireline network interface 124. That is, as earlier explained, perhaps all the benign events 42 are reserved for the wireline broadband connection (illustrated as reference numeral 84 in FIG. 9). The electronic database 112 of events may thus have entries specifying the wireline broadband connection 84 for any event identifier 110 associated with a "benign" level of the priority 72. The security controller 34 may cache or hold back the video data 28 associated with any benign event 42 until the wireline broadband connection 84 is available (e.g., its network connectivity 80 is confirmed or verified, again as FIG. 9 illustrated). Indeed, exemplary embodiments may command or enforce the general rule 114 (illustrated in FIG. 8) that the wireline broadband connection 84 is preferred for all events 40, regardless of the priority 72. However, if the event identifier 110 indicates the "alarm" priority 72, and the wireline broadband connection 84 is down (e.g., its network connectivity 80 indicates unavailable), the routing strategy 70 may authorize or permit routing the video data 28 via the wireless connection 90 into the private cellular network 96. The routing strategy 70, in other words, may override or supersede the general rule 114 that prefers the wireline broadband connection 84. Exemplary embodiments thus ensure that the alarm events 44 are urgently relayed. The electronic database 112 of events may thus have electronic database associations between the different events 40 and/or the different event identifiers 110 and the different routing strategies 70 and the different priorities 72.

Figure 11:
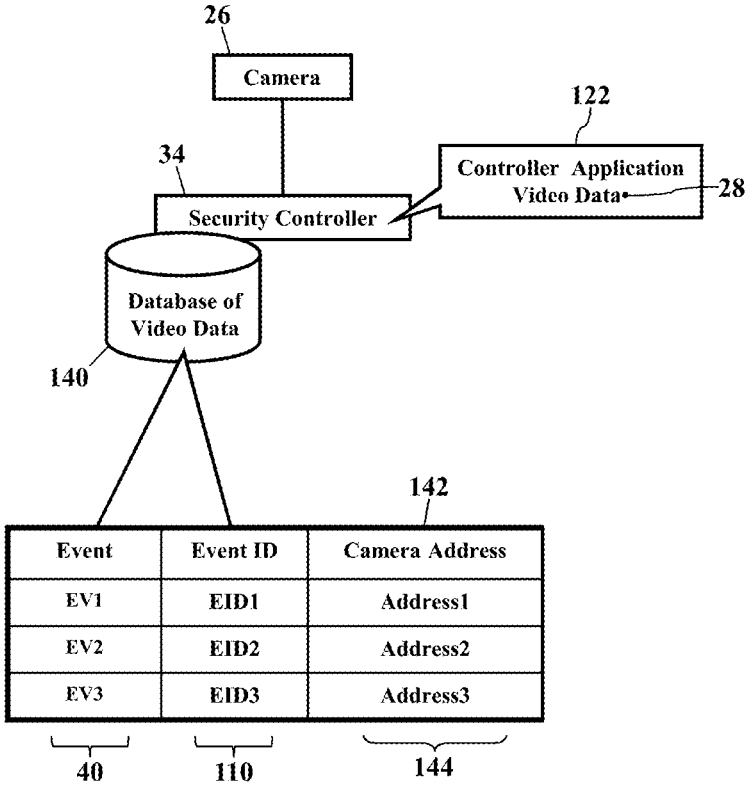
FIGS. 11-13 illustrate video data, according to exemplary embodiments.
Figure 12:
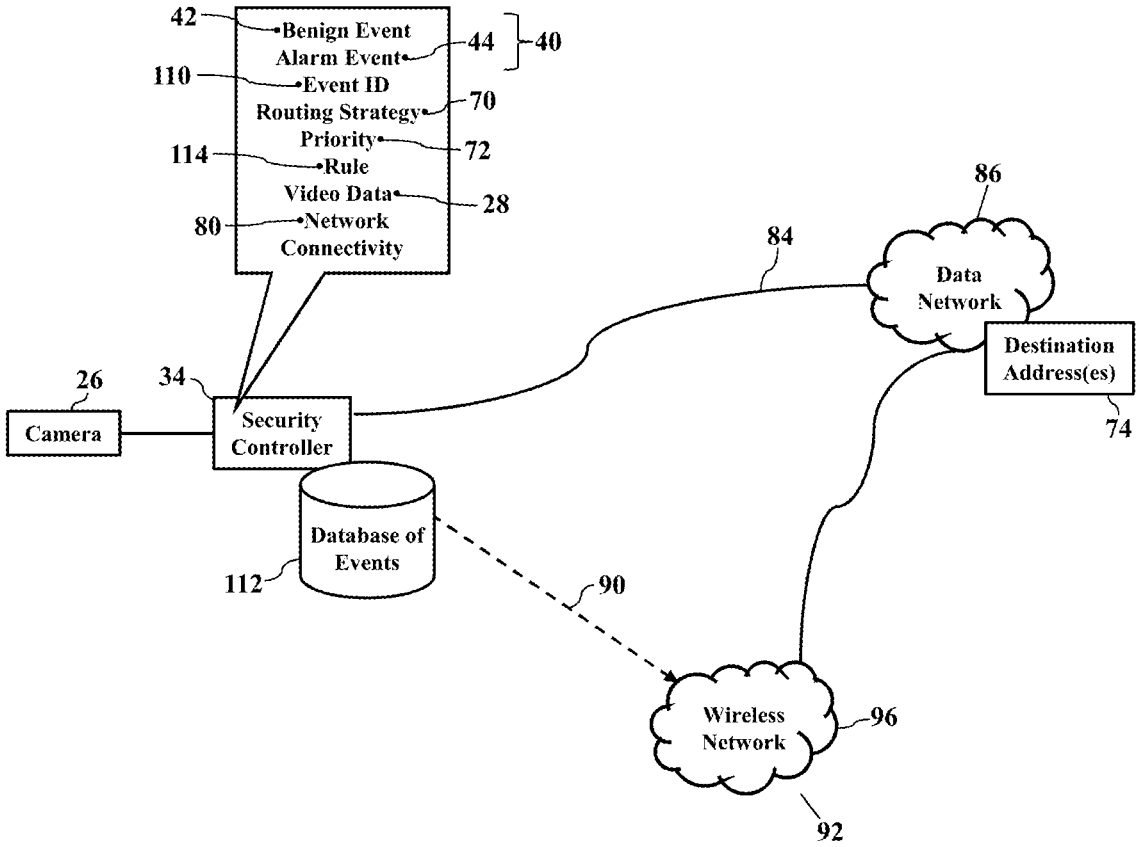
Figure 13:
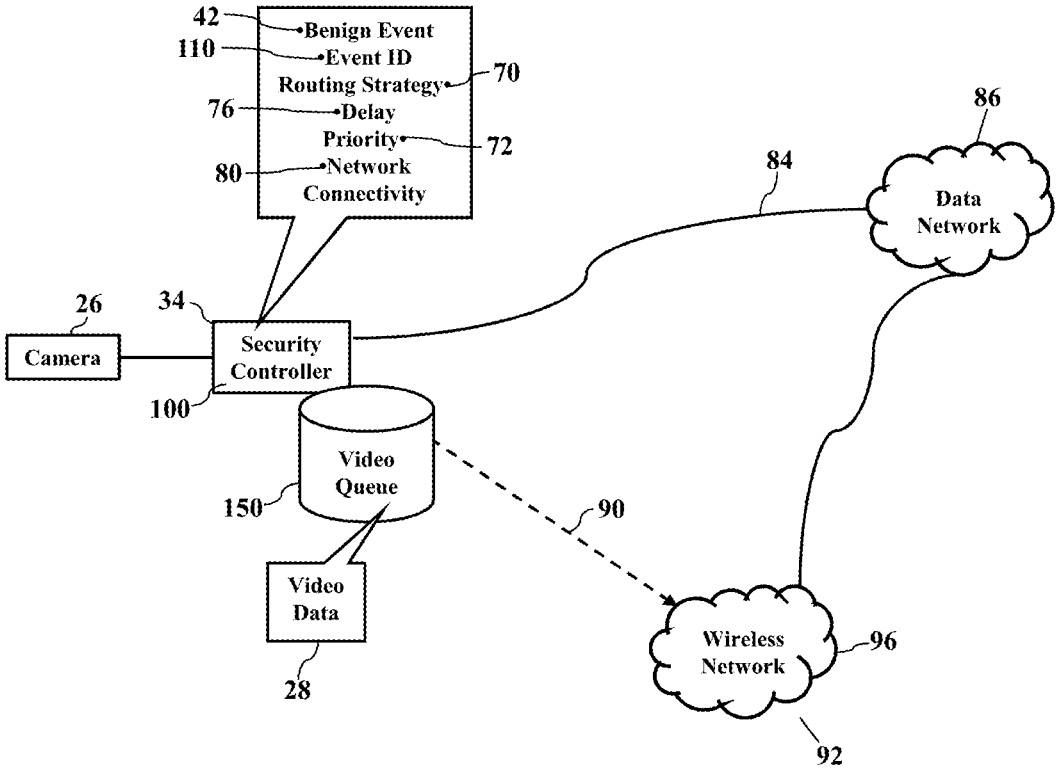

FIGS. 11-13 illustrate the video data 28, according to exemplary embodiments. When the security controller 34 determines the event 40, exemplary embodiments may also capture and/or retrieve the corresponding video data 28. As FIG. 11 illustrates, the controller application 122 may query a database 140 of video data. The database 140 of video data stores or indicates the video data 28 that is generated by the cameras 26. The video data 28 may be streamed in real-time or archived. However, because there may be multiple cameras 26 in the home or business, exemplary embodiments may select the camera 26 that best provides video of the event 40. FIG. 11 illustrates the database 140 of video data as a table 142 that maps, relates, or associates the different events 40 and/or the different event identifiers 110 to different camera addresses 144. The database 140 of video data may thus define relationships that best capture the video data 28 that corresponds to the event 40. When the controller application 122 determines the event 40 and/or the event identifier 110, the controller application 122 may query the database 140 of video data and retrieve the corresponding camera address 144 having an electronic database association with the query search term. The controller application 122 may then send a video request to the camera address 144 (such as a public or private Internet Protocol address). Once the camera address 144 is known, exemplary embodiments may obtain the corresponding video data 28 to further verify the event 40.

FIG. 12 further illustrates the video data 28. Once the video data 28 is determined, the controller application 122 may consult the database 112 of events and retrieve the routing strategy 70. The routing strategy 70, as earlier explained, may be based on the event 40 and/or the event identifier 110. Again, as one example, the general routing rule 114 may prefer the wireline broadband connection 84 for all the different events 40. All the corresponding video data 28 may thus be sent over the wireline broadband connection 84 to conserve resources in the cellular network 96. However, when the network connectivity 80 indicates the wireline broadband connection 84 is unavailable, the routing strategy 70 may authorize or permit wireless routing for alarm events 44. The routing strategy 70 may thus override or supersede the general routing rule 114 to permit sending the associated video data 28 via the wireless connection 90 into the private cellular network 96. The routing strategy 70 thus ensures that video confirmation of the alarm events 44 is performed with concomitant concern.

FIG. 13 illustrates queuing of the video data 28. When the routing strategy 70 implements the delay 76, the corresponding video data 28 may be queued until the network connectivity 80 indicates the wireline broadband connection 84 is restored and thus available. The controller application 122 may thus establish or store a video queue 150 in its local memory 100. The video queue 150 maintains an ordered arrangement or listing of the video data 26 that has been delayed and cached (per the delay 76). That is, the video queue 150 may hold the corresponding video data 28 until the wireline broadband connection 84 is restored. The controller application 122 may thus release the video data 28 in turn, such as according to position and/or chronological time (e.g., FIFO or FILO).

Exemplary embodiments, though, may release according to the priority 72. This disclosure previously explained how each different event 40, and thus its associated video data 28, may be associated with the corresponding priority 72. So, even though the event 40 may have the "benign" priority 72 and be delayed for queuing, there may still be a hierarchy according to the different priorities 72. For example, if the alarm events 44 have the highest priorities 72 (such as "1" and "2" on a numeric scale), other events 40 may have lesser priorities 72 (such as "3" through "10"). The video queue 150 may thus continually rearrange the video queue 150 according to the priority 72 retrieved from the electronic database 112 of events. The video data 28 associated with the lowest priority 72 event 40 (e.g., "10") may thus be shuffled or demoted to a bottom position in the video queue 150. Other video data 28 may be promoted to upper positions in the video queue 150 according to their corresponding priority 72. The controller application 122 may thus release the video data 28 according to its corresponding priority 72.

Figure 14:
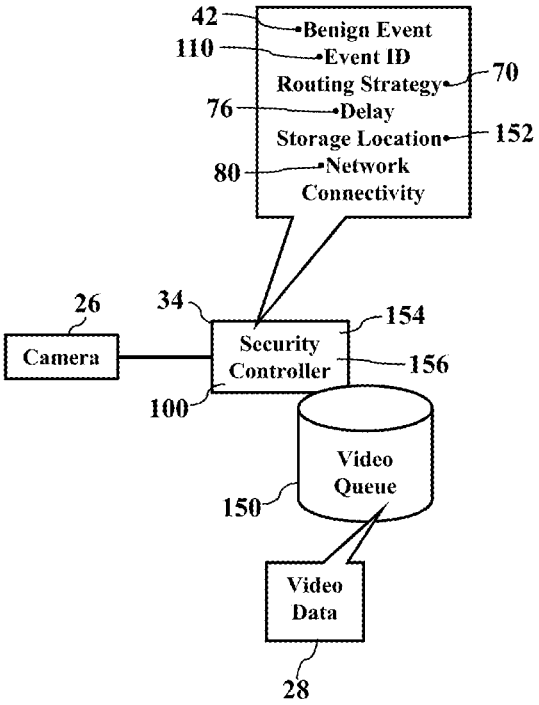
FIGS. 14-15 illustrate memory allocation, according to exemplary embodiments.
Figure 15:
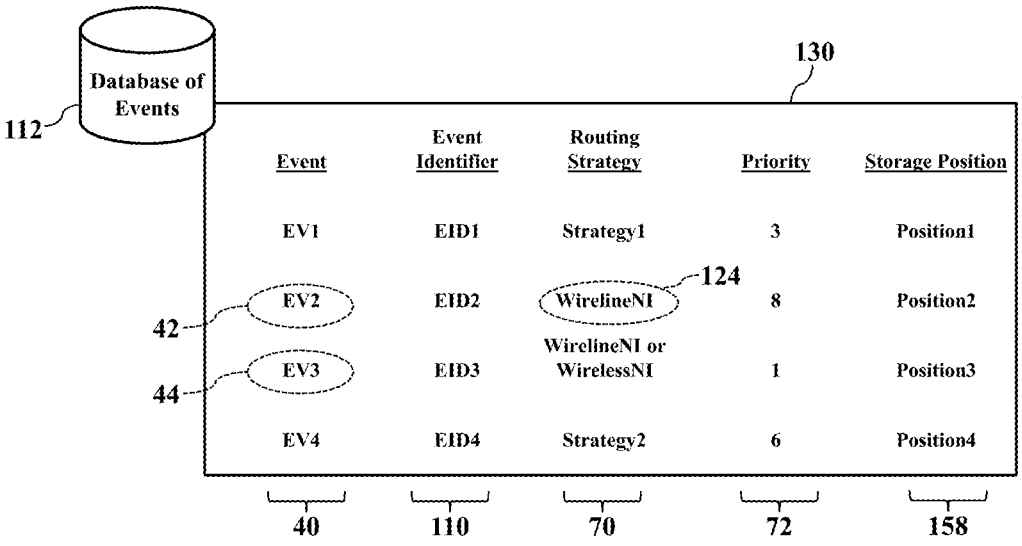

FIGS. 14-15 illustrate memory allocation, according to exemplary embodiments. Here exemplary embodiments may allocate different storage locations 152 associated with the video queue 150. That is, a first portion 154 of the memory 100 may be allocated for the video data 28 that corresponds to the alarm events 44. A different second portion 156 of the memory 100, though, may be allocated for the video data 28 that is queued in the video queue 150. FIG. 15 thus illustrates the electronic database 112 of events having additional database entries for a storage position 158. Once the controller application 122 determines the event 40 and/or its corresponding event identifier 110, the controller application 122 may also retrieve the corresponding storage position 158. The storage position 158 may thus be a pointer where the corresponding video data 28 may be stored. Exemplary embodiments may thus allocate the storage position 158 based on the event 40 generated by the security controller 34.

Figure 16:
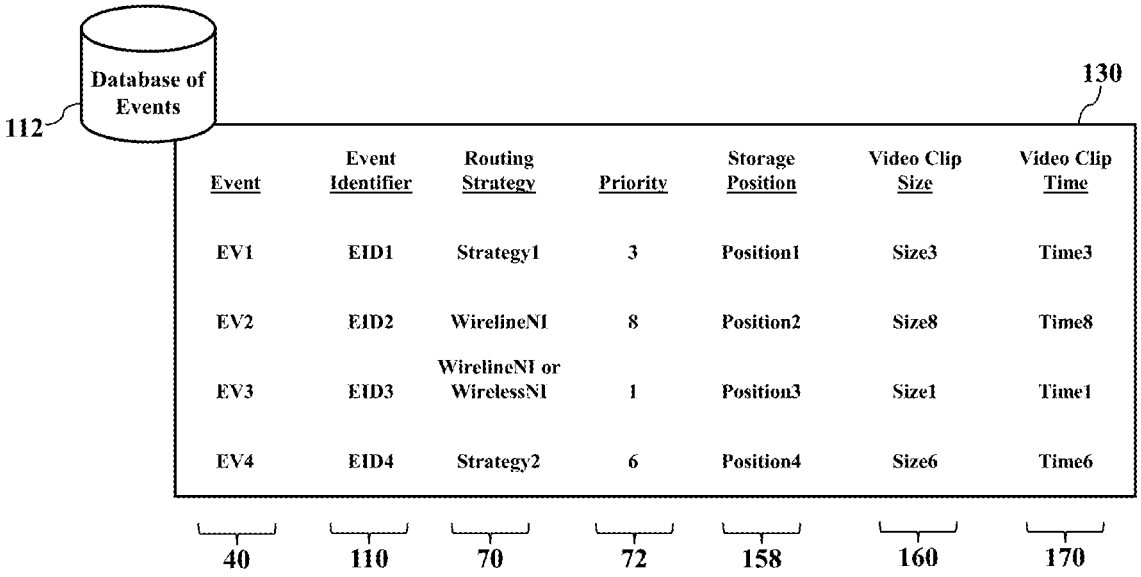
FIG. 16 further illustrates the electronic database of events, according to exemplary embodiments.

FIG. 16 further illustrates the electronic database 112 of events, according to exemplary embodiments. Here exemplary embodiments may specify parameters associated with the video data 28 that corresponds to the event 40. That is, the electronic database 112 of events may have additional database entries for a video clip size 160. The video clip size 160 may be a permissible amount (perhaps in bytes) of the video data 28 that is collected and sent for the corresponding event 40. For example, the important or urgent alarm events 44 may be permitted a larger amount of the video data 28 (such as 100 MB or even more). That is, if a fire or intrusion is detected, the security controller 34 may be permitted to send a greater amount of the video data 28 to ensure the emergency is fully documented. Events with higher priority 72, in other words, may be permitted a greater amount of the video data 28. Events 40 with lower priority 72 may be confined or reduced to a smaller amount of the video data 28. The video clip size 160 may of course depend on resolution, as higher definition video data 28 consumes more memory space than low definition. Regardless, the video clip size 160 may be any value representing a maximum value. Once the video data 28 attains the permissible video clip size 160 for the corresponding event identifier 110, the security controller 34 may truncate or stop further collection of the video data 28. The video clip size 160 may thus be another scheme for conserving network resources (especially for the video data 28 sent into the cellular network 96). Exemplary embodiments may thus determine the event identifier 110 and then query for the permissible video clip size 160.

Exemplary embodiments may further implement a video clip time 170. The electronic database 112 of events may have even more database entries that associate each event 40 to its corresponding video clip time 170. The video clip time 170 may be a permissible amount in time (perhaps seconds or even minutes) associated with the video data 28 that is collected and sent for the corresponding event 40. For example, the important or urgent alarm events 44 may be permitted a longer time for the video data 28. That is, if a fire or intrusion is detected, the security controller 34 may be permitted to send a longer time of the video data 28 to ensure the emergency is fully documented. Events with higher priority 72, in other words, may be permitted longer times for the video data 28. Events 40 with lower priority 72 may be trimmed in length to ensure the maximum permissible video clip time 170. Once the time length of the video data 28 attains the permissible video clip time 170 for the corresponding event identifier 110, the security controller 34 may edit or stop further collection of the video data 28. The video clip time 170 may thus be another scheme for conserving network resources (especially for the video data 28 sent into the cellular network 96). Exemplary embodiments may thus determine the event identifier 110 and then query for the permissible video clip time 170.

Figure 17:
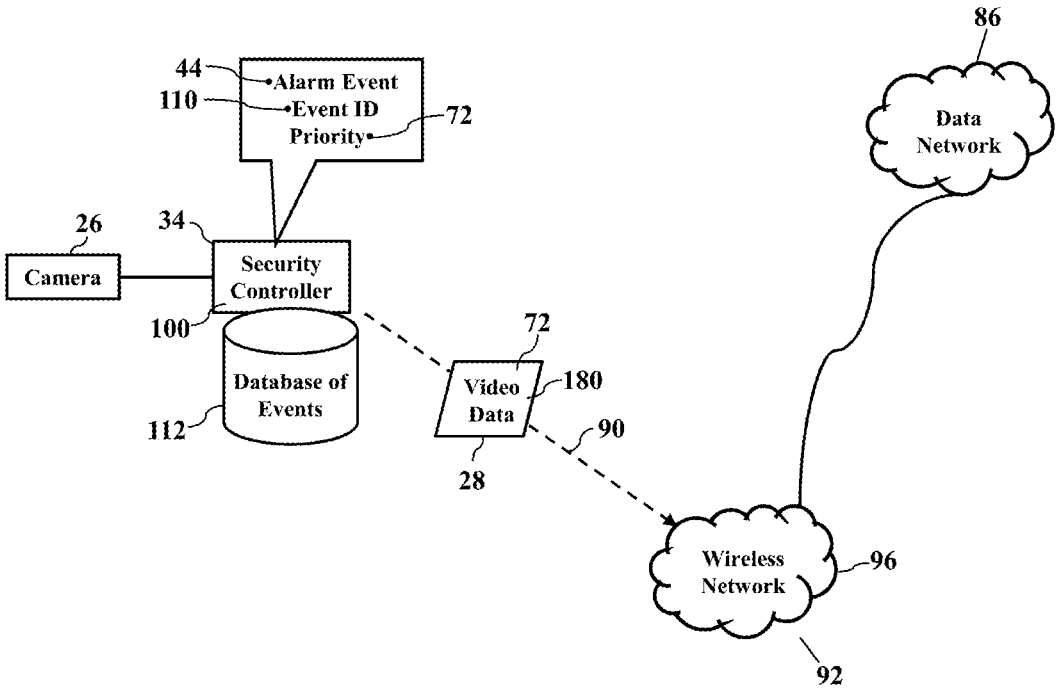
FIG. 17 illustrates packet priorities, according to exemplary embodiments.

FIG. 17 illustrates packet priorities, according to exemplary embodiments. Here the video data 28 transmitted into either the private cellular network 96 and/or the data network 86 may be prioritized over other traffic. For example, each alarm event 44 has its corresponding priority 72 (determined from the electronic database 112 of events). When the documentary video data 28 is sent via the wireless connection 90 into the private cellular network 96, for example, the video data 28 may indicate or include its associated priority 72. That is, once the priority 72 is known, the priority 72 may be added to the video data 28 associated with the alarm event 44 and the event identifier 110. The priority 72, for example, added to a packet 180 containing at least a portion of the video data 28. When the security controller 34 sends the video data 28, the wireless network interface (illustrated as reference numeral 126 in FIG. 9) may packetize communications or messages into packets of data according to a packet protocol, such as the Internet Protocol. The packets of data contain bits or bytes of data describing the contents, or payload, of a message. A header of each packet 180 of data may contain routing information identifying an origination address and/or a destination address. There are many different known packet protocols, and the Internet Protocol is widely used, so no detailed explanation is needed. For example, exemplary embodiments may add the priority 72 as a bit or byte to the header of the packet 180. The packet 180 may thus have a designated field or position reserved for the priority 72 retrieved from the electronic database 112 of events. As the packet 180 is processed by components in the private cellular network 96 and/or the data network 86, any component may retrieve/read the priority 72 in the header and route or process ahead of other packets, thus again ensuring that video confirmation of the alarm events 44 is performed with concomitant concern.

Figure 18:
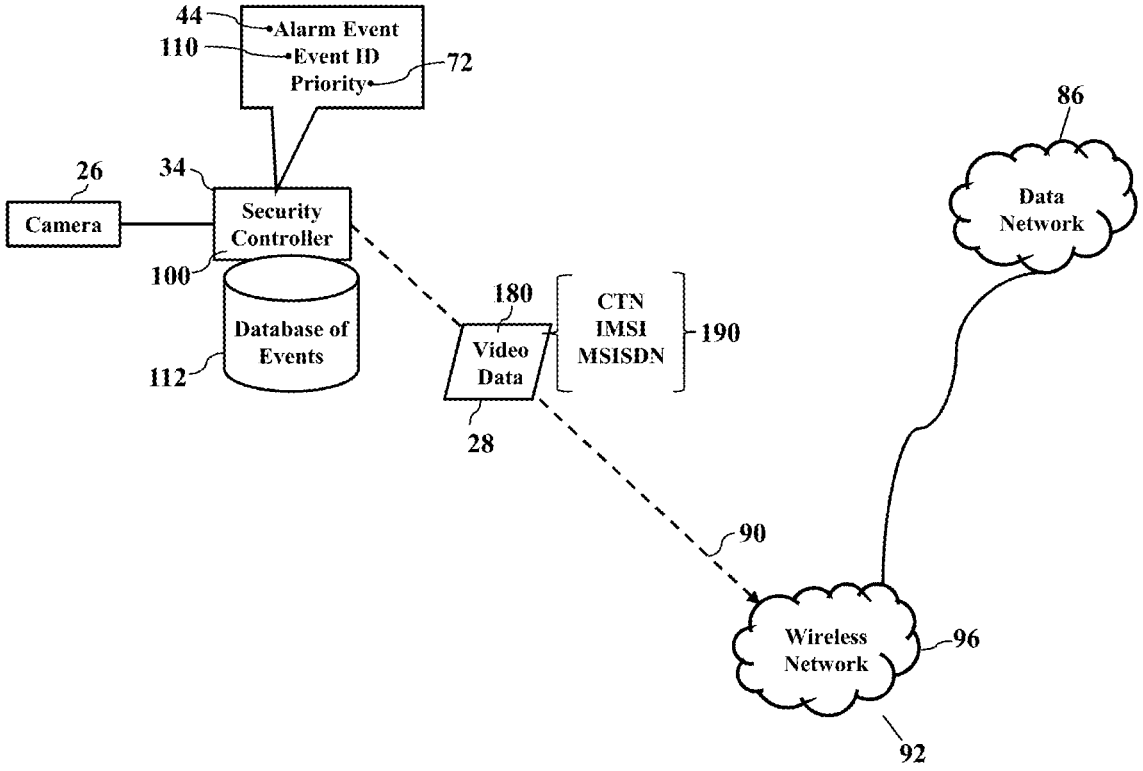
FIG. 18 illustrates cellular communication, according to exemplary embodiments.

FIG. 18 illustrates cellular communication, according to exemplary embodiments. As the security controller 34 may have cellular transmission capabilities, the security controller 34 allows device-to-device communication using cellular frequencies and standards. When the security controller 34 sends the video data 28, the video data 28 may also include a cellular identifier 190 that uniquely identifies the security controller 34. For example, each packet 180 containing the video data 28 may also include a cellular telephone number ("CTN"), International Mobile Subscriber Identity (or "IMSI"), or Mobile Station International Subscriber Directory Number ("MSISDN"). Exemplary embodiments may thus identify the security controller 34 transmitting the video data 28 having the priority 72.

Figure 19:
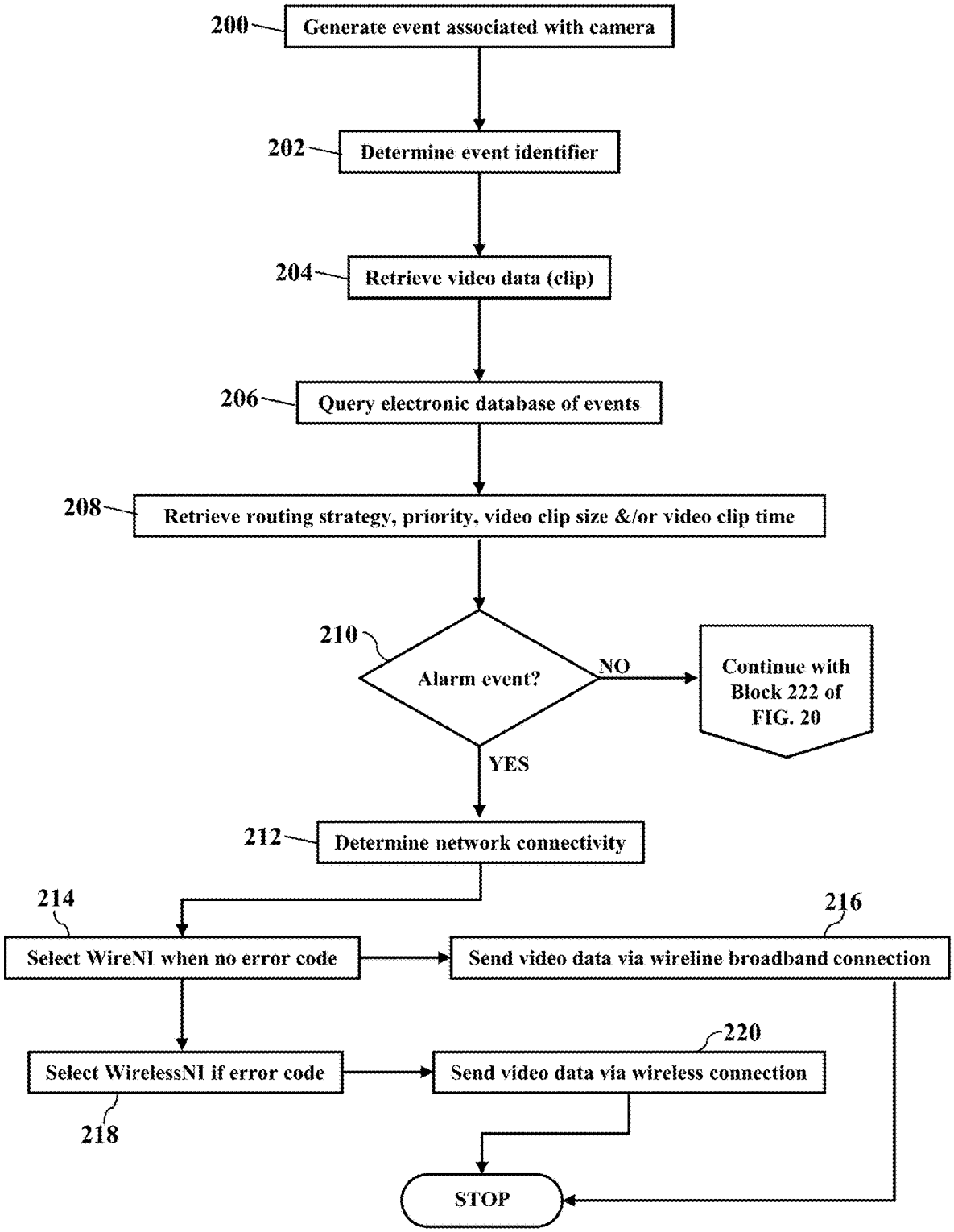
FIGS. 19-20 are flowcharts illustrating an algorithm or method for alarm reporting, according to exemplary embodiments.
Figure 20:
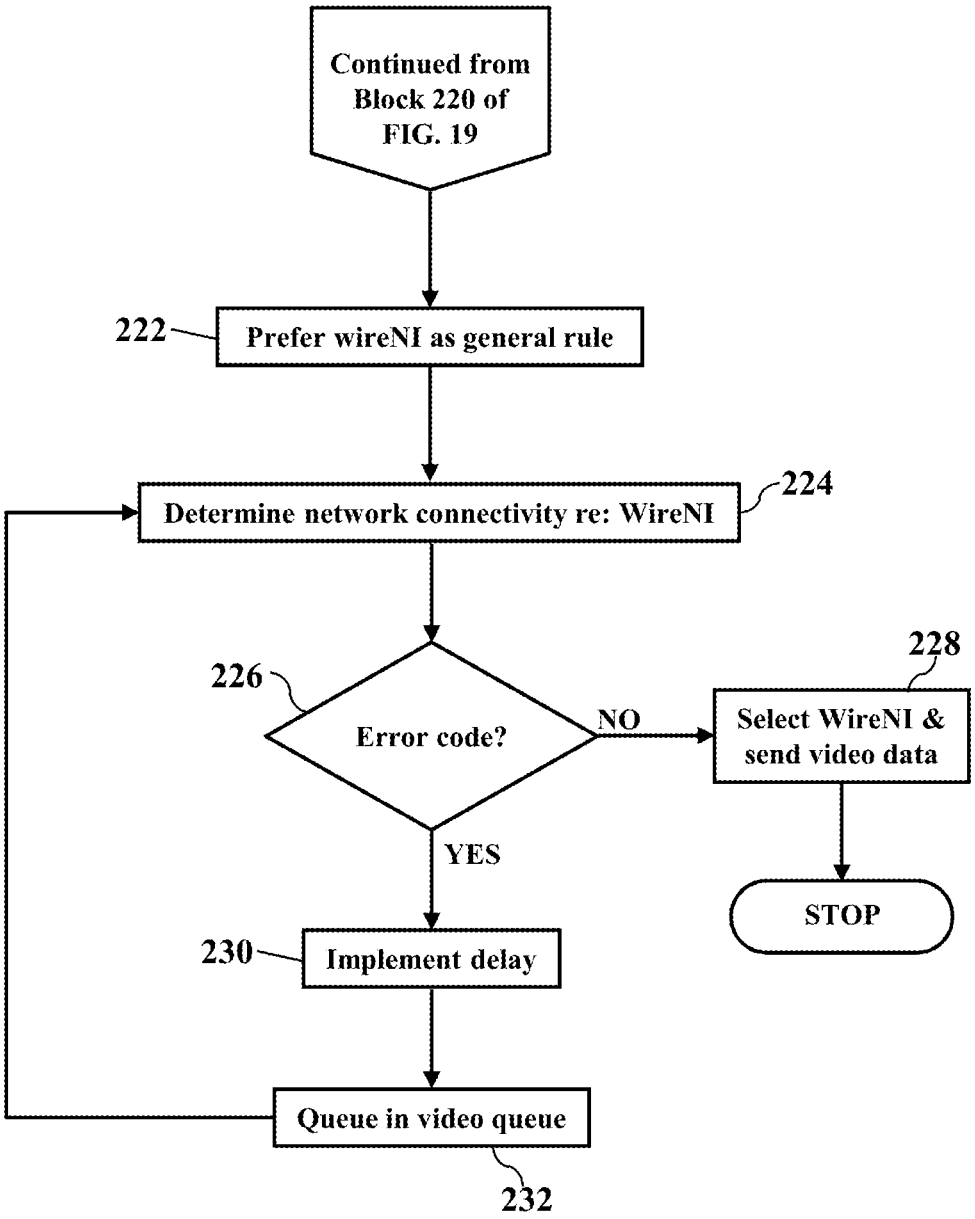

FIGS. 19-20 are flowcharts illustrating an algorithm or method for alarm reporting, according to exemplary embodiments. The event 40 is generated (Block 200) and the event identifier 110 is determined (Block 202). The video data 28 is retrieved (Block 204). The electronic database 112 of events is queried (Block 206) and the routing strategy 70, the priority 72, the video clip size 160 and/or the video clip time 170 may be retrieved (Block 208). If the event 40 and/or the event identifier 110 is associated with one of the alarm events 44 (Block 210), then the network connectivity 80 is determined (Block 212). The wireline network interface ("WireNI") 124 may be selected when available (e.g., no error code) (Block 214). The video data 28 is sent via the wireline broadband connection 84 (Block 216). However, the wireless network interface ("WirelessNI") 126 may be selected when an error code associated with the wireline network interface 124 is determined (Block 218). The video data 28 is sent via the wireless connection 90 (Block 220).

The flowchart continues with FIG. 20. If the event 40 and/or the event identifier 110 is not associated with one of the alarm events 44 (see Block 210 of FIG. 19), then the wireline network interface ("WireNI") 124 may be preferred as the general rule 114 (Block 222). The network connectivity 80 associated with the wireline network interface ("WireNI") 124 is determined (Block 224). If no error code is determined (Block 226), then the wireline network interface ("WireNI") is selected and the video data 28 is sent via the wireline broadband connection 84 (Block 228). However, if an error code is determined (Block 226), then the delay 76 is implemented (Block 230) and the video data 28 is queued in the video queue 150 (Block 232). The network connectivity 80 may then be randomly or periodically re-evaluated or re-determined (Block 224) until no error code is determined (Block 226). The video data 28 may thus be sent via the wireline broadband connection 84 (Block 228).

Figure 21:
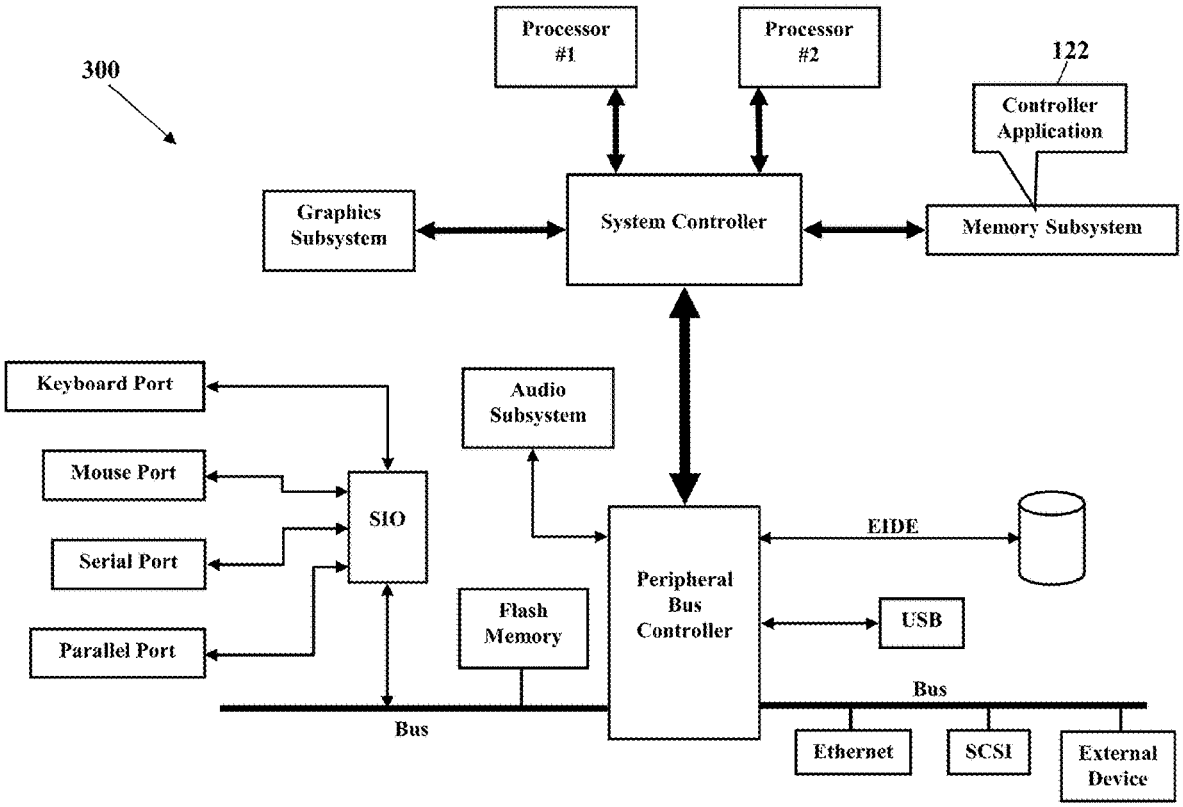
FIGS. 21-25 depict still more operating environments for additional aspects of the exemplary embodiments.

FIG. 21 depicts other possible operating environments for additional aspects of the exemplary embodiments. FIG. 21 illustrates the controller application 122 operating within various other processor-controlled devices 300. FIG. 21, for example, illustrates a set-top box ("STB") (302), a personal/digital video recorder (PVR/DVR) 304, a Global Positioning System (GPS) device 306, an interactive television 308, a tablet computer 310, or any computer system, communications device, or processor-controlled device utilizing the processor and/or a digital signal processor (DP/DSP) 312. The device 300 may also include watches, radios, vehicle electronics, clocks, printers, gateways, mobile/implantable medical devices, and other apparatuses and systems. Because the architecture and operating principles of the various devices 300 are well known, the hardware and software componentry of the various devices 300 are not further shown and described.

Figure 22:
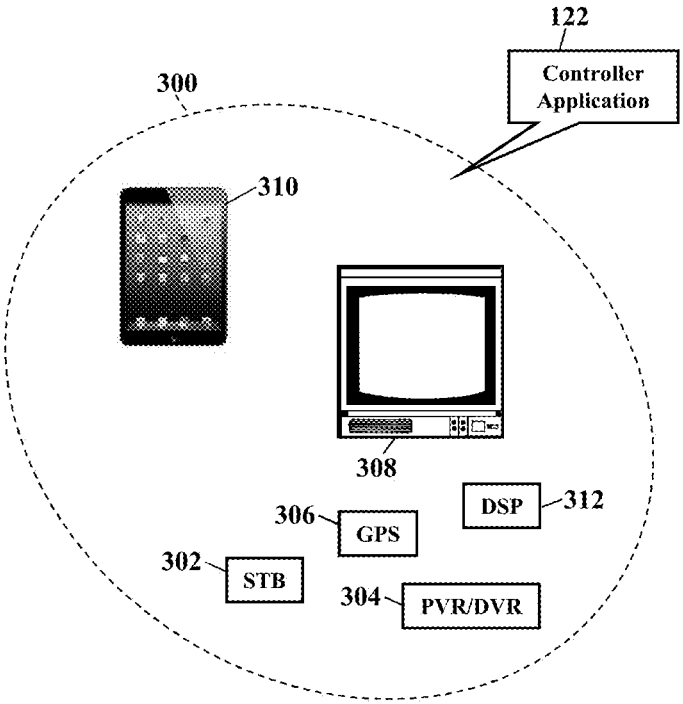
Figure 23:
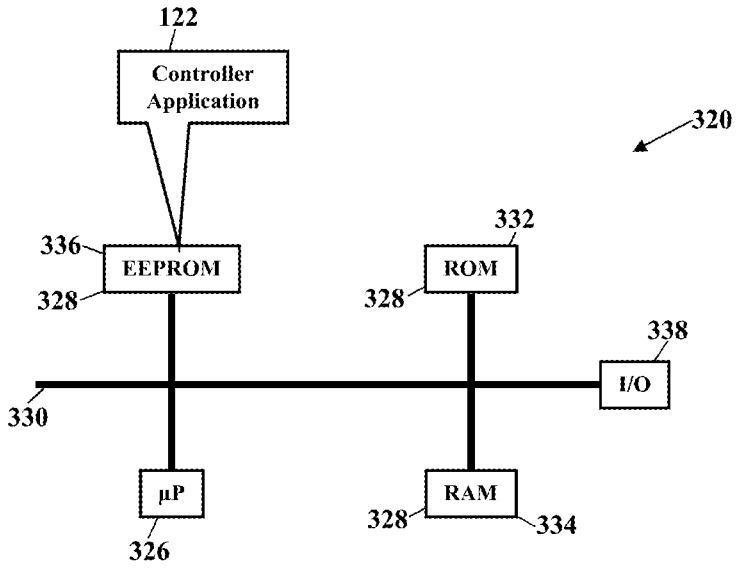
Figure 24:
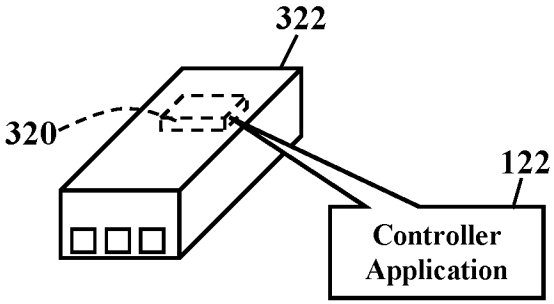

FIGS. 22-24 are schematics further illustrating the processor-controlled device 300, according to exemplary embodiments. FIG. 22 is a block diagram of a Subscriber Identity Module 320, while FIGS. 23 and 24 illustrate, respectively, the Subscriber Identity Module 320 embodied in a plug 322 and in a card 324. As those of ordinary skill in the art recognize, the Subscriber Identity Module 320 may be used in conjunction with many devices (such as the security controller 34 and the smartphone 60 illustrated in FIGS. 1-3). The Subscriber Identity Module 320 stores user information (such as the cellular identifier 190 illustrated in FIG. 18) and any portion of the controller application 122. As those of ordinary skill in the art also recognize, the plug 322 and the card 324 each may interface with any mobile or stationary device.

FIG. 22 is a block diagram of the Subscriber Identity Module 320, whether embodied as the plug 322 of FIG. 23 or as the card 324 of FIG. 24. Here the Subscriber Identity Module 320 comprises a microprocessor 326 (μP) communicating with memory modules 328 via a data bus 330. The memory modules 328 may include Read Only Memory (ROM) 332, Random Access Memory (RAM) and or flash memory 334, and Electrically Erasable-Programmable Read Only Memory (EEPROM) 336. The Subscriber Identity Module 320 stores some or all of the controller application 122 in one or more of the memory modules 328. An Input/Output module 338 handles communication between the Subscriber Identity Module 320 and a host device. Because Subscriber Identity Modules are well known in the art, this patent will not further discuss the operation and the physical/memory structure of the Subscriber Identity Module 320.

Figure 25:
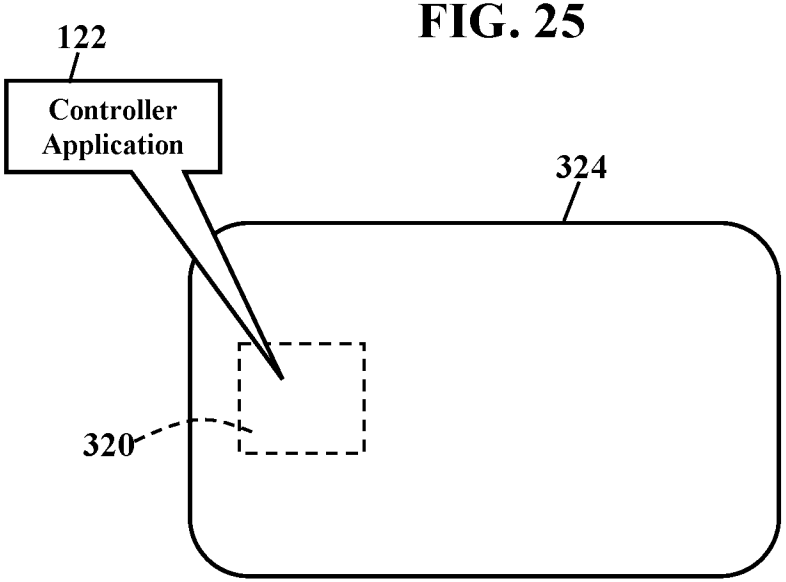
Figure 26:
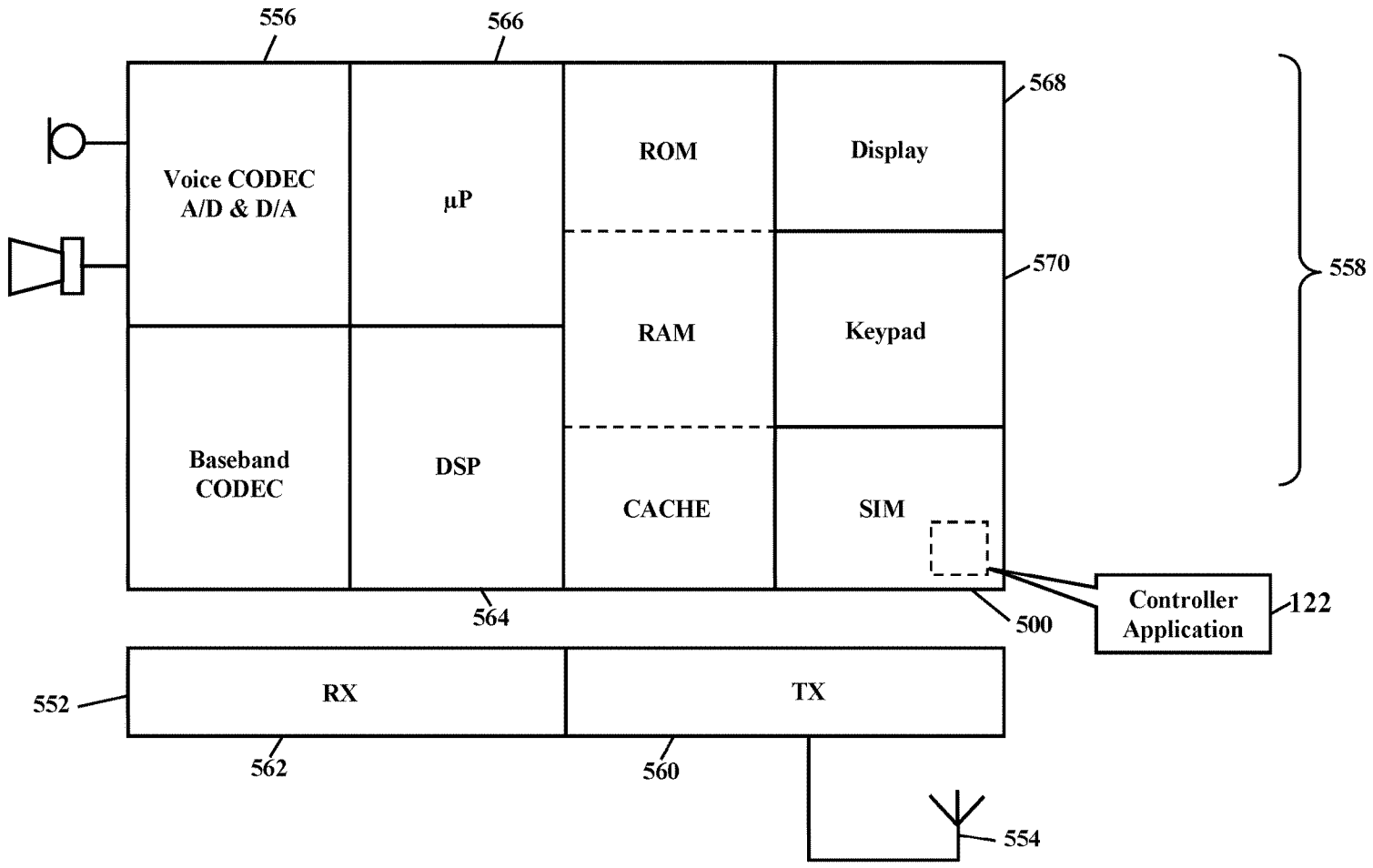

FIG. 25 is a schematic further illustrating the operating environment, according to exemplary embodiments. FIG. 25 is a block diagram illustrating more possible componentry of the security controller 34. The componentry may include one or more radio transceiver units 352, an antenna 354, a digital baseband chipset 356, and a man/machine interface (MMI) 358. The transceiver unit 352 includes transmitter circuitry 360 and receiver circuitry 362 for receiving and transmitting radio-frequency (RF) signals. The transceiver unit 352 couples to the antenna 354 for converting electrical current to and from electromagnetic waves. The digital baseband chipset 356 contains a digital signal processor (DSP) 364 and performs signal processing functions for audio (voice) signals and RF signals. As FIG. 25 shows, the digital baseband chipset 356 may also include an on-board microprocessor 366 that interacts with the man/machine interface (MMI) 358. The man/machine interface (MMI) 358 may comprise a display device 368, a keypad 370, and the Subscriber Identity Module 320. The on-board microprocessor 366 may also interface with the Subscriber Identity Module 320.

Exemplary embodiments may be applied to any signaling standard. As those of ordinary skill in the art recognize, FIGS. 20-25 may illustrate a Global System for Mobile (GSM) communications device. That is, the communications device may utilize the Global System for Mobile (GSM) communications signaling standard. Those of ordinary skill in the art, however, also recognize that exemplary embodiments are equally applicable to any communications device utilizing the Time Division Multiple Access signaling standard, the Code Division Multiple Access signaling standard, the "dual-mode" GSM-ANSI Interoperability Team (GAIT) signaling standard, or any variant of the GSM/CDMA/TDMA signaling standard. Exemplary embodiments may also be applied to other standards, such as the I.E.E.E. 802 family of standards, the Industrial, Scientific, and Medical band of the electromagnetic spectrum, BLUETOOTH®, and any other.

Exemplary embodiments may be physically embodied on or in a computer-readable memory device or other storage media/medium. This computer-readable medium, for example, may include CD-ROM, DVD, tape, cassette, floppy disk, optical disk, memory card, memory drive, and large-capacity disks. This computer-readable medium, or media, could be distributed to end-subscribers, licensees, and assignees. A computer program product comprises processor-executable instructions for alarm reporting, as the above paragraphs explained.

While the exemplary embodiments have been described with respect to various features, aspects, and embodiments, those skilled and unskilled in the art will recognize the exemplary embodiments are not so limited. Other variations, modifications, and alternative embodiments may be made without departing from the spirit and scope of the exemplary embodiments.

The invention claimed is:

1. A method, comprising:

determining, by an alarm controller, a security event associated with a security system;

retrieving, by the alarm controller, a video data that is associated with the security event determined by the alarm controller, querying, by the alarm controller, an electronic database for the security event, the electronic database electronically associating network interfaces and security events;

in response to the electronic database identifying the security event as a benign event of the security events, then conserving a wireless bandwidth by a routing of the video data via a wireline network interface of the network interfaces; and in response to the electronic database identifying the security event as an urgent event of the security events, then prioritizing the routing of the video data via a wireless network interface of the network interfaces.

2. The method of claim 1, further comprising retrieving an event identifier from the electronic database, the event identifier electronically associated with the security event determined by the alarm controller.

3. The method of claim 2, further comprising selecting the wireline network interface based on the event identifier.

4. The method of claim 2, further comprising selecting the wireless network interface based on the event identifier.

5. The method of claim 1, further comprising sending the video data via a wireline broadband connection.

6. The method of claim 1, further comprising identifying a priority in the electronic database that is electronically associated with the security event determined by the alarm controller.

7. The method of claim 6, further comprising selecting the wireless network interface based on the priority.

8. The method of claim 7, further comprising wirelessly transmitting the video data via a wireless connection to a cellular network in response to the priority.

9. The method of claim 7, further comprising sending the video data via a wireline broadband connection in response to the priority.

10. A system, comprising:

a hardware processor; and a memory device, the memory device storing instructions, the instructions that when executed causing the hardware processor to perform operations, the operations comprising:

determining an event by an alarm controller associated with a security system;

retrieving a video data associated with the event determined by the alarm controller;

querying an electronic database for the event, the electronic database electronically associating a wireline network interface to benign events;

if the electronic database identifies the event as one of the benign events, then conserving wireless bandwidth by a routing of the video data via the wireline network interface to a data network; and if the electronic database fails to identify the event as one of the benign events, then determining that the event is an urgent event and prioritizing the routing of the video data via a wireless network interface to a wireless network.

11. The system of claim 10, wherein the operations further comprise retrieving an event identifier from the electronic database, the event identifier electronically associated with the event determined by the alarm controller.

12. The system of claim 11, wherein the operations further comprise selecting the wireless network interface based on the event identifier.

13. The system of claim 12, wherein the operations further comprise wirelessly transmitting the video data via a cellular network.

14. The system of claim 12, wherein the operations further comprise sending the video data via a wireline broadband connection.

15. The system of claim 10, wherein the operations further comprise retrieving a priority from the electronic database that is electronically associated with the event determined by the alarm controller.

16. The system of claim 15, wherein the operations further comprise selecting the wireless network interface to the wireless network based on the priority.

17. The system of claim 16, wherein the operations further comprise wirelessly transmitting the video data via a cellular network in response to the priority.

18. The system of claim 16, wherein the operations further comprise sending the video data via the wireless network interface to the wireless network in response to the priority.

19. A memory device storing instructions that when executed cause a hardware processor to perform operations, the operations comprising:

determining an event by an alarm controller associated with a security system;

assigning an event identifier to the event determined by the alarm controller;

retrieving a video data associated with the event determined by the controller;

querying an electronic database for the event identifier, the electronic database electronically associating a wireline network interface to benign event identifiers;

if the electronic database identifies the event identifier as one of the benign event identifiers, then conserving a cellular bandwidth by delaying a routing of the video data via the wireline network interface to a data network; and if the electronic database fails to identify the event as one of the benign events, then determining that the event is a health and safety event and urgently prioritizing the routing of the video data via a wireless network interface to a wireless network.

* * * * *